US011708990B2

(12) United States Patent
Chu et al.

(10) Patent No.: US 11,708,990 B2
(45) Date of Patent: Jul. 25, 2023

(54) AIR PURIFIER AND CONTROL METHOD THEREFOR

(71) Applicant: Samsung Electronics Co., Ltd., Suwon-si (KR)

(72) Inventors: Euysung Chu, Suwon-si (KR); Moonsun Shin, Suwon-si (KR); Inchul Yun, Suwon-si (KR); Byungghun Kim, Suwon-si (KR); Wooseog Song, Suwon-si (KR); Dongwoo Woo, Suwon-si (KR); Sekwan Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 361 days.

(21) Appl. No.: 16/772,520

(22) PCT Filed: Dec. 4, 2018

(86) PCT No.: PCT/KR2018/015217
§ 371 (c)(1),
(2) Date: Jun. 12, 2020

(87) PCT Pub. No.: WO2019/117523
PCT Pub. Date: Jun. 20, 2019

(65) Prior Publication Data

US 2020/0386423 A1 Dec. 10, 2020

(30) Foreign Application Priority Data

Dec. 15, 2017 (KR) ..... 10-2017-0173664

(51) Int. Cl.
*F24F 11/65* (2018.01)
*F24F 13/20* (2006.01)
(Continued)

(52) U.S. Cl.
CPC ..... *F24F 11/65* (2018.01); *F24F 8/10* (2021.01); *F24F 8/80* (2021.01); *F24F 13/20* (2013.01);
(Continued)

(58) Field of Classification Search
CPC ..... F24F 8/10; F24F 13/20; F24F 2110/64; F24F 2120/12; F24F 11/65; F24F 2013/205
See application file for complete search history.

(56) References Cited

U.S. PATENT DOCUMENTS 5,207,614 A 5/1993 Passadore
5,971,067 A * 10/1999 Rayburn ..... F24F 11/30 165/250
(Continued)

FOREIGN PATENT DOCUMENTS

CN 101363644 2/2009
CN 102748817 10/2012
(Continued)

OTHER PUBLICATIONS

International Search Report dated Apr. 4, 2019 from International Application No. PCT/KR2018/015217, 4 pages.
(Continued)

*Primary Examiner* — Alicia M. Choi
(74) *Attorney, Agent, or Firm* — Staas & Halsey LLP

(57) ABSTRACT

An air cleaner includes: a housing including an inlet and an outlet for air; an air blower configured to blow air introduced through the inlet to the outlet; a panel configured to face the outlet and including holes; a driver configured to move the panel with respect to the housing; and a controller configured to control the driver to move the panel to open or close a channel between the outlet and the panel and adjust an air
(Continued)

volume discharged through the holes of the panel. Thus, the air cleaner prevents a cold draft phenomenon.

15 Claims, 18 Drawing Sheets

(51) Int. Cl.
*F24F 8/10* (2021.01)
*F24F 8/80* (2021.01)
*F24F 110/64* (2018.01)
*F24F 120/12* (2018.01)

(52) U.S. Cl.
CPC ..... *F24F 2013/205* (2013.01); *F24F 2110/64* (2018.01); *F24F 2120/12* (2018.01)

(56) References Cited

U.S. PATENT DOCUMENTS

| | | | | |
|---|---|---|---|---|
| 10,302,353 | B2 * | 5/2019 | Uchida | F25D 17/065 |
| 2006/0201077 | A1 * | 9/2006 | Kamano | B60H 1/3421 52/199 |
| 2006/0234622 | A1 | 10/2006 | Holyoake | |
| 2008/0119125 | A1 * | 5/2008 | Guerreiro | B60H 1/345 454/75 |
| 2009/0210193 | A1 * | 8/2009 | Nagase | F24F 11/30 250/208.2 |
| 2009/0314164 | A1 * | 12/2009 | Yamashita | F24F 6/043 96/245 |
| 2012/0318010 | A1 | 12/2012 | Matsumoto et al. | |
| 2013/0103207 | A1 * | 4/2013 | Ruff | G06F 3/0482 700/278 |
| 2014/0000852 | A1 * | 1/2014 | Kim | F24F 7/007 454/284 |
| 2015/0306533 | A1 * | 10/2015 | Matlin | F24F 3/16 96/417 |
| 2021/0332742 | A9 * | 10/2021 | Park | F01P 7/16 |

FOREIGN PATENT DOCUMENTS

| | | | | | |
|---|---|---|---|---|---|
| CN | 102840646 | | | 12/2012 | |
| CN | 204739747 | | | 11/2015 | |
| CN | 106123120 | | | 11/2016 | |
| CN | 205747183 | | | 11/2016 | |
| CN | 106403031 | | | 2/2017 | |
| CN | 106403031 | A | * | 2/2017 | F24F 13/00 |
| CN | 206073277 | U | | 4/2017 | |
| EP | 1018626 | | | 7/2000 | |
| EP | 2 466 221 | | | 5/2016 | |
| JP | 05261230 | A | * | 10/1993 | B01D 46/46 |
| JP | 2004-176995 | | | 6/2004 | |
| JP | 2016099032 | A1 | * | 5/2016 | F24F 11/02 |
| JP | 2016-165682 | | | 9/2016 | |
| JP | 2016165682 | A | * | 9/2016 | F24F 11/02 |
| KR | 10-2001-0037821 | | | 5/2001 | |
| KR | 10-2003-0055051 | A | | 7/2003 | |
| KR | 10-2005-0003625 | A | | 1/2005 | |
| KR | 10-2005-0017518 | | | 2/2005 | |
| KR | 10-0529910 | | | 11/2005 | |
| KR | 10-2009-0014729 | | | 2/2009 | |
| KR | 20-2009-0000987 | | | 2/2009 | |
| KR | 20090042056 | A | * | 5/2009 | F24F 13/08 |
| KR | 10-1195883 | | | 10/2012 | |
| KR | 10-2014-0012437 | | | 2/2014 | |
| KR | 10-2014-0019106 | | | 2/2014 | |
| KR | 10-2017-0009698 | | | 1/2017 | |
| KR | 10-2017-0009807 | A | | 1/2017 | |
| KR | 10-2017-0043908 | | | 4/2017 | |
| WO | WO2016024351 | A1 | * | 2/2016 | F24F 7/00 |

OTHER PUBLICATIONS

Chinese Office Action dated Apr. 19, 2021 from Chinese Application No. 201880079665.2, 21 pages.
Extended European Search Report dated Dec. 16, 2020 from European Application No. 18887438.2, 8 pages.
Chinese Office Action dated Nov. 29, 2021 from Chinese Application No. 201880079665.2.
Korean Office Action dated Jan. 24, 2022 from Korean Application No. 10-2017-0173664.

* cited by examiner

AIR PURIFIER AND CONTROL METHOD THEREFOR

CROSS-REFERENCE TO RELATED APPLICATIONS

This application is a U.S. National Stage Application which claims the benefit under 35 U.S.C. § 371 of International Patent Application No. PCT/KR2018/015217 filed on Dec. 4, 2018, which claims foreign priority benefit under 35 U.S.C. § 119 of Korean Patent Application No. 10-2017-0173664 filed on Dec. 15, 2017 in the Korean Intellectual Property Office, the contents of each of which are incorporated herein by reference.

TECHNICAL FIELD

The disclosure relates to an air cleaner for controlling various properties of air in a use space in response to a user's request and a control method thereof, and more particularly to an air cleaner structured to discharge air, a predetermined property of which is controlled, to the outside and a control method thereof.

BACKGROUND ART

An air conditioner refers to an apparatus provided to control properties such as temperature, humidity, cleanness, air current, etc. in response to a use space. The air conditioner basically includes an air blower forming air current, and changes at least one of properties of air circulated by the air blower, thereby making the environment of the use space comfortable for a user. The air conditioner is classified according to the properties of air to be controlled, and may for example include an air cooler for cooling air, a dehumidifier for lowering humidity of air, an air cleaner for enhancing cleanness of air.

The air cleaner refers to an apparatus for filtering out fine dust or gas from air in a space such as a room, etc. and additionally sterilizing air. Specifically, the air cleaner sucks polluted indoor air, moves the sucked air into a housing, and filters out dust, odor particles, etc. from the air, thereby purifying air and discharging the purified air out of the housing.

A conventional air cleaner has a structure that a spatial volume of an air outlet provided in the housing is constant and air flow is controlled based on how many times an air-blowing fan revolves per unit time. In this case, air discharged through the air outlet may be biased toward a certain space. Such air biasedly discharged from the air outlet may cause a cold draught (or a cold draft) that makes a user feel uncomfortable with the biased air on the user's body. Further, in the conventional air cleaner, the amount of wind may be varied depending on positions at which air is discharged under a certain air volume. When air is not uniformly discharged throughout the air outlet, it is impossible for the air cleaner to evenly purify the whole use space, or it takes long time to fully purify the whole use space.

Further, the air cleaner may operate in a mode where the amount of air circulation is so low that a user can hardly feel the air circulation. For example, the air cleaner may operate in a mode where the amount of air circulation is relatively low while a user is sleeping. In such a case where the amount of air discharged per unit time is low and air is biasedly discharged from some space of the air outlet, the air cleaning function of the air cleaner may not work properly.

Accordingly, an air cleaner is required to have a simple structure by which air inside the housing is uniformly discharged through a preset space.

Technical Solution

According to an embodiment of the disclosure, an air cleaner includes: a housing including an inlet and an outlet for air; an air blower configured to blow air introduced through the inlet to the outlet; a panel configured to face the outlet and including holes; a driver configured to move the panel with respect to the housing; and a controller configured to control the driver to move the panel to open or close a channel between the outlet and the panel and adjust an air volume discharged through the holes of the panel. Thus, the air cleaner prevents a cold draft phenomenon according to the operation modes.

Here, the controller may move the panel to a first position, at which the channel is closed, in a first mode among a plurality of operation modes, and move the panel to a second position, at which the channel is opened, in a second mode of which air volume blown by the air blower is more than the air volume in the first mode.

Here, the air cleaner may further include at least one grill plate coupled to at least one of the housing and the panel, disposed between the air blower and the panel, and formed with holes, wherein the holes of the panel have smaller diameters than the holes of the grill plate.

Further, the driver may include: a least one rack extended from the panel toward the housing; at least one pinion rotatably coupled to the housing and meshed with the rack; and a motor driving the at least one pinion to rotate, and the controller may control the motor to rotate the at least one pinion to close or open the channel.

Further, the air cleaner may further include a first sensor to detect a user within a preset range of the air cleaner, wherein the controller stops moving the panel when the first sensor detects a user while the panel is moving.

Further, the air cleaner may further include a storage configured to store scheduling information in which time to enter the first mode is set, wherein the controller enters the first mode when a current time corresponds to the time set in the scheduling information.

Further, the air cleaner may further include a second sensor configured to detect dust concentration of a use environment of the air cleaner, wherein the controller enters the first mode based on the dust concentration detected by the second sensor not higher than a first threshold, but does not enter the first mode based on the detected dust concentration higher than the first threshold.

Here, the controller may display a user interface (UI) for selecting whether to automatically enter the first mode, and perform control to automatically enter the first mode based on selection using the UI.

Further, according to an embodiment of the disclosure, an air cleaner includes: a housing including an inlet and an outlet for air; an air blower configured to blow air introduced through the inlet to the outlet; a panel configured to face the outlet, spaced apart from the outlet to form a discharging channel for the air, and including holes; a door rotatably provided in the housing and configured to open or close the discharging channel; a driver configured to rotate the door; and a controller configured to control the driver to rotate the door to open or close the discharging channel and adjust an air volume discharged through the holes of the panel.

Further, according to an embodiment of the disclosure, a method of controlling an air cleaner includes: by an air blower, blowing air introduced through an inlet of a housing to an outlet of the housing; and adjusting an air volume discharged through holes of a panel by moving the panel to open or close a channel between the outlet and the panel facing the outlet and formed with the holes.

Here, the adjusting of the air volume may include: moving the panel to a first position, at which the channel is closed, in a first mode among a plurality of operation modes; and moving the panel to a second position, at which the channel is opened, in a second mode of which air volume blown by the air blower is more than the air volume in the first mode.

Further, the air cleaner may include: a least one rack extended from the panel toward the housing; and at least one pinion rotatably coupled to the housing and meshed with the rack, and the adjusting of the air volume includes rotating the at least one pinion to close or open the channel.

Further, the method of controlling the air cleaner may further include stopping moving the panel when a user is detected within a preset range of the air cleaner while the panel is moving.

Further, the moving of the panel to the first position may include entering the first mode when a current time corresponds to time which is set to enter the first mode in previously stored scheduling information.

Further, the method of controlling the air cleaner may further include entering the first mode based on dust concentration in a user environment of the air cleaner not higher than a first threshold; and not entering the first mode based on the detected dust concentration higher than the first threshold.

Further, the method of controlling the air cleaner may further include counting the number of times of entering the first mode, and automatically entering the first mode based on the number of counting times.

Here, the automatic entering of the first mode may include displaying a user interface (UI) for selecting whether to automatically enter the first mode, and automatically entering the first mode based on selection using the UI.

BEST MODE

Below, embodiments will be described in detail with reference to accompanying drawings. Further, the embodiments described with reference to the accompanying drawings are not exclusive to each other unless otherwise mentioned, and a plurality of embodiments may be selectively combined within one apparatus. The combination of these plural embodiments may be discretionally selected and applied to realize the present inventive concept by a person having an ordinary skill in the art.

In the description of the embodiments, an ordinal number used in terms such as a first element, a second element, etc. is employed for describing variety of elements, and the terms are used for distinguishing between one element and another element. Therefore, the meanings of the elements are not limited by the terms, and the terms are also used just for explaining the corresponding embodiment without limiting the disclosure.

Further, a term "at least one" among a plurality of elements in the disclosure represents not only all the elements but also each one of the elements, which excludes the other elements or all combinations of the elements.

Figure 1:
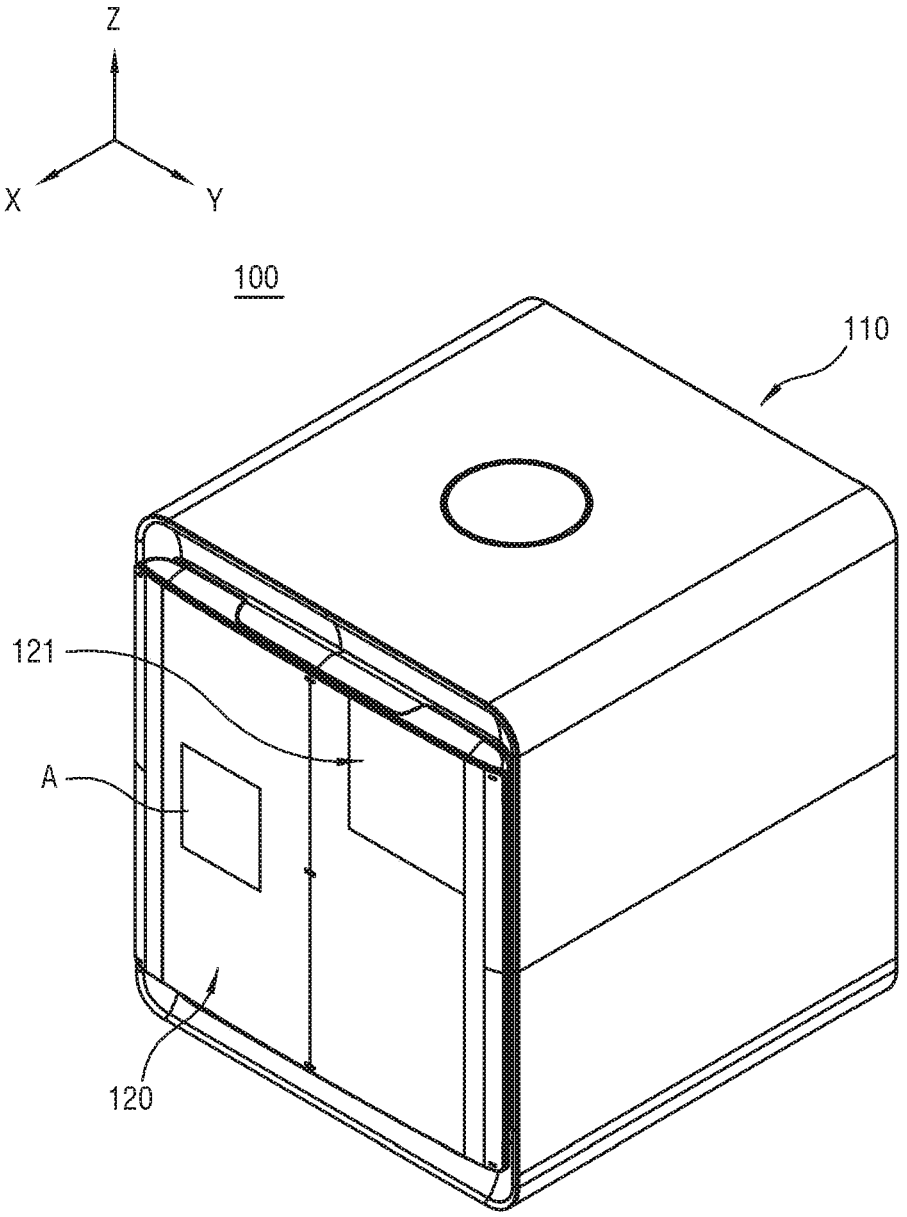
FIG. 1 is a perspective view showing an outer appearance of an air cleaner according to an embodiment of the disclosure in a predetermined first mode.

FIG. 1 is a perspective view showing an outer appearance of an air cleaner according to an embodiment of the disclosure in a predetermined first mode.

As shown in FIG. 1, an air cleaner 100 according to an embodiment of the disclosure includes a housing 110 of which an outer appearance is generally shaped like a cube and edge and vertexes are rounded. The air cleaner 100 introduces air of an use environment into the housing 110 through the back of the housing 110, filters out dust or gas from the air introduced into the housing 110, and discharges air from the inside of the housing 110 to the outside through the front of the housing 110.

The concept of the disclosure may be applied to various kinds of air conditioners, and the air cleaner 100 in this embodiment is merely an example of the air conditioner. In other words, the air conditioner to which the concept of the disclosure is applied is not limited to the air cleaner 100, but may be embodied by various apparatuses such as an air-cooler, dehumidifier, etc.

In the accompanying drawings, 'X', 'Y' and 'Z' indicate three directions orthogonal to one another in a space. The opposite directions to 'X', 'Y' and 'Z' are represented with '−X', '−Y' and '−Z', respectively. In the following embodiments, for convenience of description, the direction of 'X' may represent a frontward direction of the air cleaner, and the direction of '−X' may represent a backward direction of the air cleaner. Further, when a plane is parallel with two axes among the axes of three directions, the other one axis is in a direction normal to the plane. For example, the direction of 'X' is normal to the plane of 'Y-Z'.

The back and front of the housing 110 are formed with openings, respectively. The opening in the back of the housing 110 is used as an inlet through which air outside the housing 110 is introduced into the housing 110, and the opening in the front of the housing 110 is used as an outlet through which air inside the housing 110 is discharged to the outside of the housing 110. Alternatively, even the left and right walls of the housing 110 may be respectively formed with openings to introduce air. Here, the air cleaner 100 includes a front panel 120 installed in the front outlet of the housing 110.

The front panel 120 includes a user interface (UI) 121 provided in a predetermined first area on the surface thereof, allowing a user to make a user input, and displaying the state of the air cleaner 100, and a plurality of punching holes or through holes formed on a second area other than the first area. Through the through holes, air inside the housing 110 may be discharged to the outside in the direction of 'X'.

In the air cleaner 100 according to this embodiment, the front panel 120 may be provided to move between a position of covering the outlet of the housing 110 and a position of being spaced apart from the outlet. FIG. 1 illustrates a state that the front panel 120 is moved to the position of covering the outlet of the housing 110, and the air cleaner 100 operates with the front panel 120 of such a state in a predetermined first mode.

Below, the through holes formed in the front panel 120 will be described.

Figure 2:
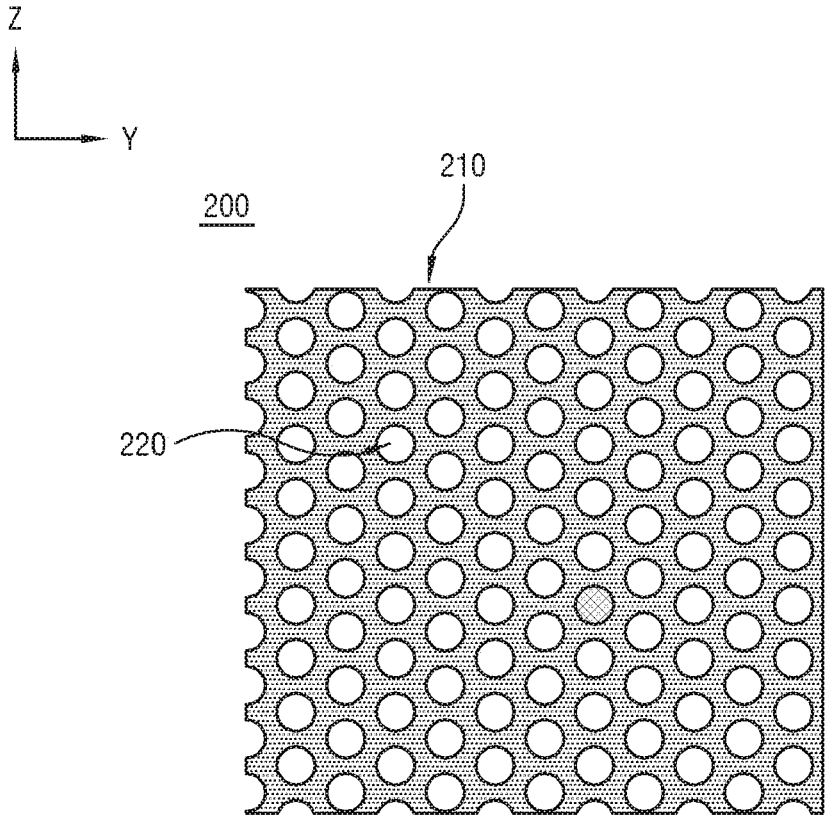
FIG. 2 is an enlarged plan view of an area A in a front panel of the air cleaner shown in FIG. 1.

FIG. 2 is an enlarged plan view of an area A in a front panel of the air cleaner shown in FIG. 1.

As shown in FIG. 2, a front panel 200 includes a plate 210, and a plurality of through holes 220 formed on the plate 210. The plurality of through holes 220 is used to discharge air inside the housing of the air cleaner to the outside. In this embodiment, the through hole 220 has a circular shape, but a specific shape of the through hole 220 does not limit the concept of the disclosure. The through hole 220 may have various shapes, such as a trigonal shape, a tetragonal shape, a pentagonal shape, a hexagonal shape, an oval shape, etc., and the shape of the through hole 220 may be modified in designing and manufacturing the air cleaner. Further, a diameter of the through hole 220, and a distance between two neighboring through holes 220 may be designed based on various experimental data, but not limited by specific numerical values.

The amount of air discharged per unit time is identified based on the shape and diameter of the through hole 220, the distance between the two through holes 220, an occupation ratio of the through holes 220 to the whole front panel 200, and the like parameters. The parameters may be related to various factors such as an environment in which the air cleaner is used, performance of an air-blowing fan, the size of the front panel 200, etc.

Below, operations of an air cleaner according to an embodiment of the disclosure will be described.

Figure 3:
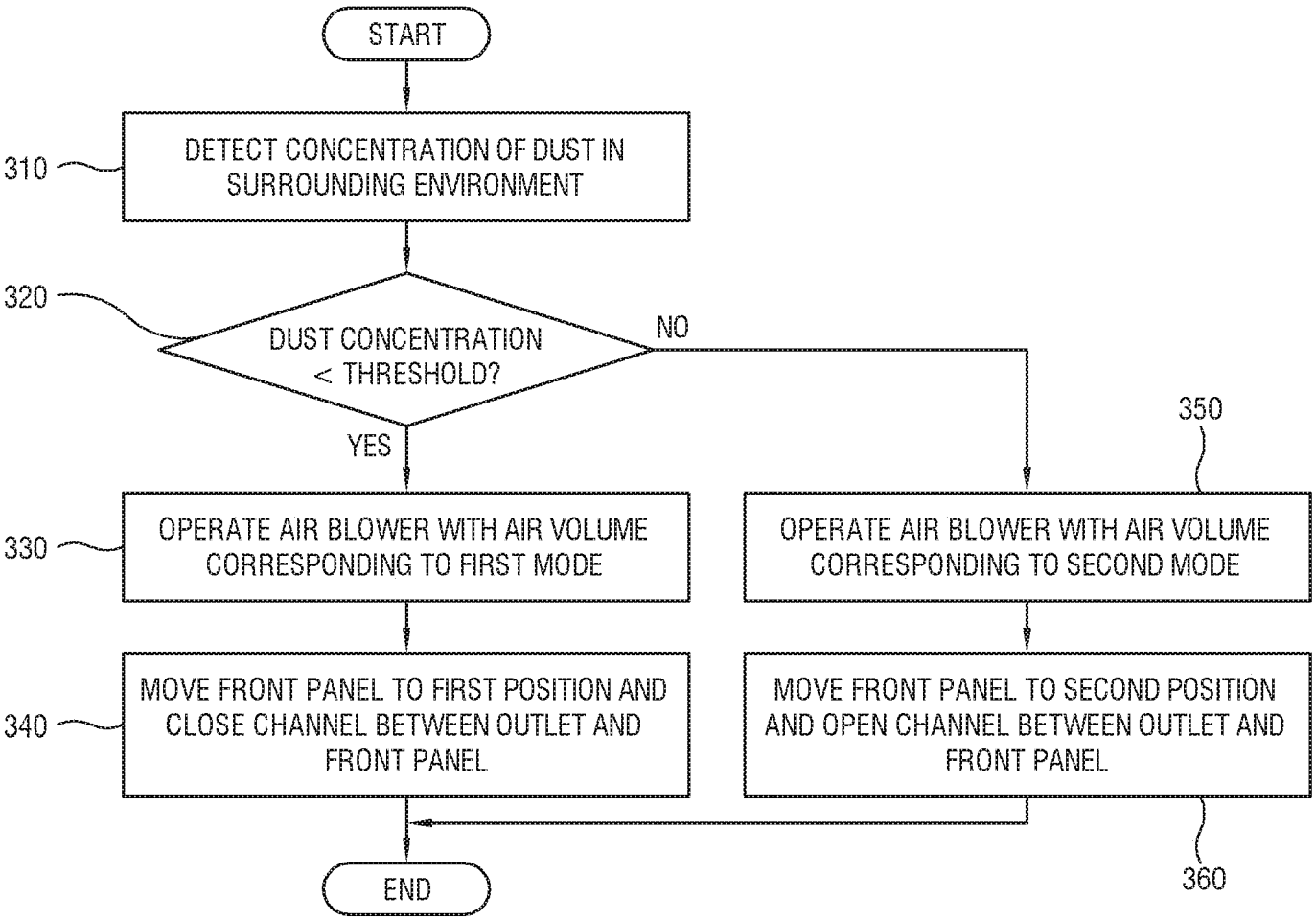
FIG. 3 is a flowchart showing a control method of an air cleaner according to an embodiment of the disclosure.

FIG. 3 is a flowchart showing a control method of an air cleaner according to an embodiment of the disclosure.

As shown in FIG. 3, the following operations are carried out by a processor or controller of the air cleaner.

At operation 310 the air cleaner may use a sensor to detect concentration of dust in a surrounding environment. The air cleaner may include various kinds of sensors, and at least one among such sensors detects a dust concentration in the use environment of the air cleaner and transmits the detected dust concentration to the controller.

At operation 320 the air cleaner identifies whether the dust concentration detected by the sensor is lower than a preset threshold.

When the dust concentration is lower than the threshold, at operation 330 the air cleaner enters a first mode among a plurality of preset operation modes, and operates an air blower with an air volume corresponding to the first mode. Here, the first mode described above and a second mode to be described later are operation modes different from each other, and each of them is one among the plurality of operation modes previously set in the air cleaner.

At operation 340 the air cleaner moves the front panel to a first position and closes a channel between the outlet and the front panel. Thus, air sent to the outlet by the air blower is dischargeable through not the channel, but only the through holes of the front panel.

On the other hand, when the dust concentration is not lower than the threshold, at operation 350 the air cleaner operates the air blower with an air volume corresponding to the second mode. Here, the air volume corresponding to the first mode is different from the air volume corresponding to the second mode.

At operation 360 the air cleaner moves the front panel to a second position and opens the channel between the outlet and the front panel. Thus, air sent to the outlet by the air blower is dischargeable through the channel.

Thus, the air cleaner according to this embodiment prevents a cold draft phenomenon from occurring to a user who is placed in front of the outlet.

In the foregoing embodiments, the air cleaner enters the first mode based on a detection result of the sensor for sensing the dust concentration. However, a method of entering the first mode may be based on a user input, or scheduling information planned in advance. In this regard, embodiments will be described below.

Figure 4:
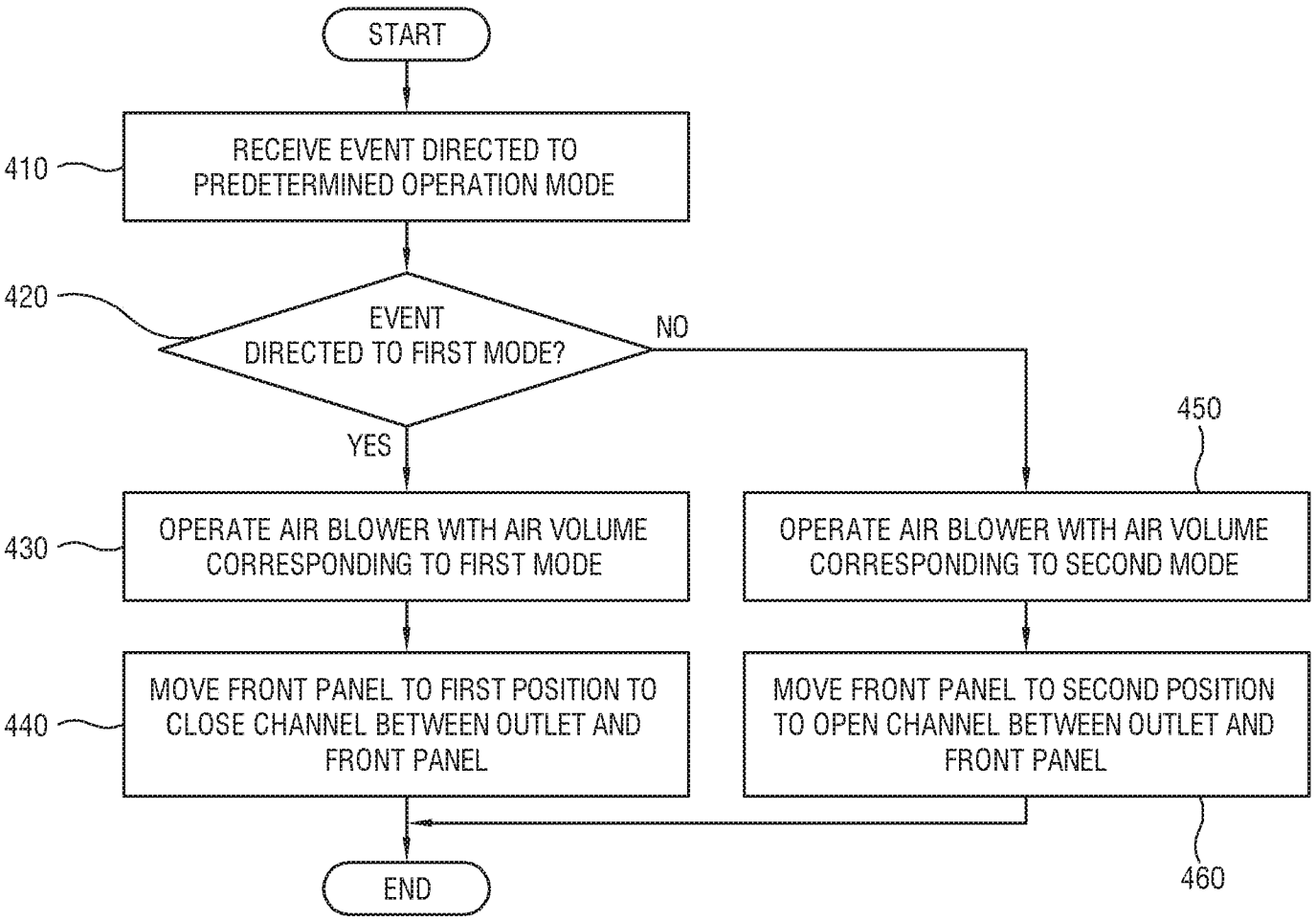
FIG. 4 is a flowchart showing a control method based on a directing event in an air cleaner according to an embodiment of the disclosure.

FIG. 4 is a flowchart showing a control method based on a directing event in an air cleaner according to an embodiment of the disclosure.

As shown in FIG. 4, the following operations are carried out by a processor or controller of the air cleaner At operation 410 the air cleaner receives an event which is directed to a predetermined operation mode among a plurality of preset operation modes. This event may occur based on input directions of a user, or may automatically occur when it reaches a set time based on preset scheduling information.

At operation 420 the air cleaner identifies whether the received event is directed to the first mode.

When the received event is directed to operation in the first mode, at operation 430 the air cleaner operates the air blower with an air volume corresponding to the first mode.

At operation 440 the air cleaner moves the front panel to the first position, thereby closing the channel between the outlet and the front panel.

On the other hand, when the received event is directed to operation in not the first mode but the second mode, at operation 450 the air cleaner operates the air blower with an air volume corresponding to the second mode.

At operation 460 the air cleaner moves the front panel to the second position, thereby opening the channel between the outlet and the front panel.

Below, the structure and operation of the disclosure will be described in more detail.

The air cleaner may have at least two operation modes according to the amount of air circulation. The first mode refers to an operation mode in which the amount of air circulation is relatively low, and may also be called a low wind-speed mode or a low air-volume mode for convenience of description. The second mode refers to an operation mode in which the amount of air circulation is relatively high, and may also be called a normal wind mode for convenience of description. Of course, the two operation modes do not mean that the air cleaner supports only two operation modes, and the air cleaner may have three or more operation modes.

The air cleaner according to an embodiment of the disclosure controls the front panel to be positioned corresponding to the current operation mode. The air cleaner moves the front panel to the first position, i.e. the position for closing the front opening of the housing in the first mode. In the first mode, air inside the housing is discharged only the through holes of the front panel. The air cleaner in the first mode is illustrated in FIG. 1.

On the other hand, the air cleaner moves the front panel to the second position, i.e. the position spaced apart from the front opening of the housing in the second mode. As the front panel moves to the second position, a vent provided between the front panel and the housing is opened, and thus air is discharged through the opened vent. Of course, air may also be discharged through the through holes of the front panel, but a relatively large volume of air is discharged through the vent.

In addition, the air cleaner may operate the air-blowing fan installed therein at rotation speed different the first mode and the second mode. The rotation speed of the air-blowing fan in the first mode is lower than that in the second mode. In the first mode, the speed and amount of air discharged from the inside of the housing are relatively decreased. Alternatively, the air cleaner may be designed to have the same rotation speed of the air-blowing fan between the first mode and the second mode.

Thus, the air cleaner according to this embodiment discharges air uniformly and evenly through the through holes of the front panel in the first mode in which the air volume is relatively low, and discharges air rapidly through the vent in the second mode in which the air volume is relatively high. In the second mode, air is discharged from a channel between the housing and the edges of the front panel through the vent, so that a user can avoid a direct strong wind. Further, air comes out through the through holes of the front panel even in the second mode. However, the air volume and wind-speed of air discharged in this case are lower than those of air discharged through the channel. Therefore, the air cleaner according to this embodiment prevents the cold draft phenomenon from occurring to a user who is positioned in front of the air cleaner in both the first mode and the second mode.

Below, it will be described that the air cleaner operates in the first mode.

Figure 5:
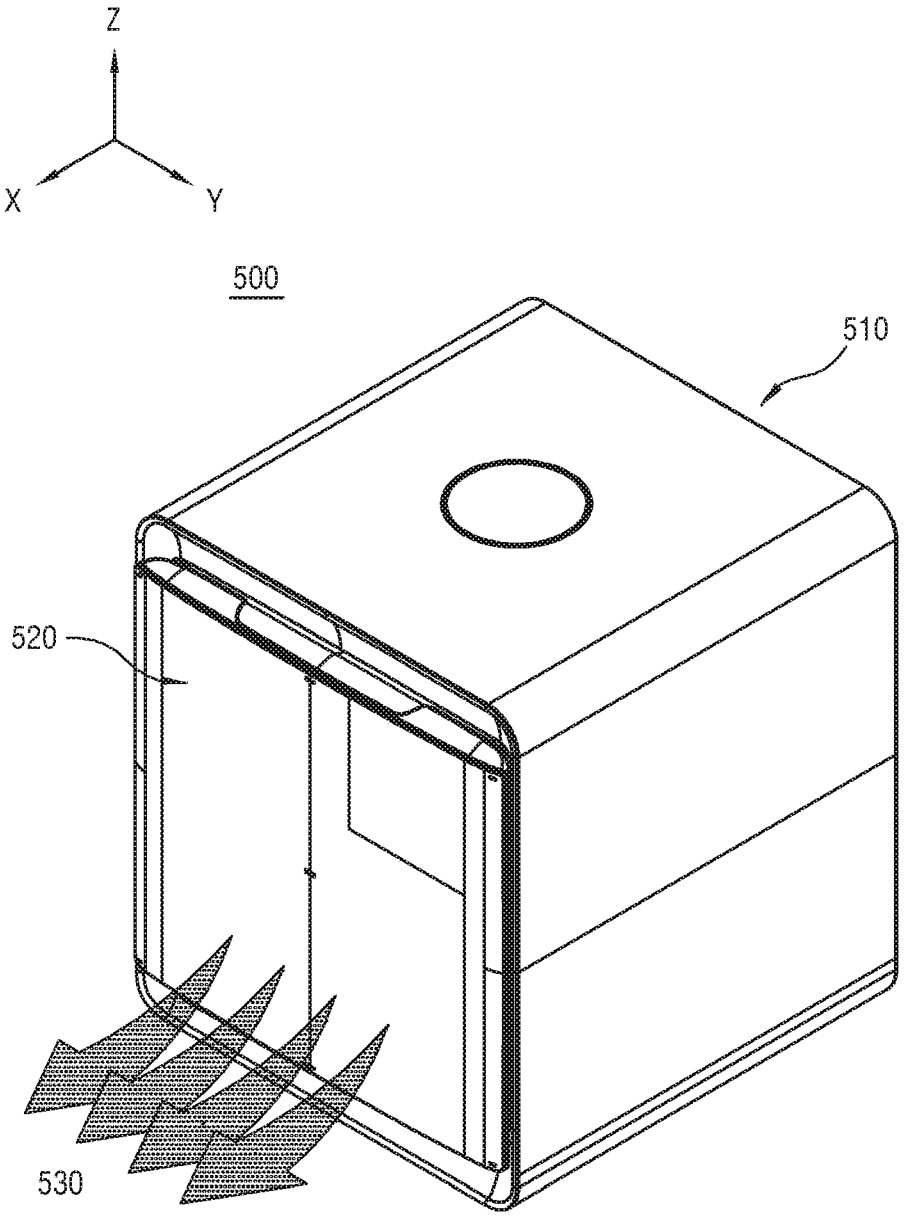
FIG. 5 is a perspective view showing an outer appearance of an air cleaner according to an embodiment of the disclosure in a first mode.

FIG. 5 is a perspective view showing an outer appearance of an air cleaner according to an embodiment of the disclosure in the first mode.

As shown in FIG. 5, an air cleaner 500 in the first mode positions a front panel 520 to be in contact with a housing 510, thereby closing the outlet of the housing 510. When the air cleaner 500 is switched over from the second mode to the first mode, the front panel 520 is moved in the direction of '−X'. Because the edges of the front panel 520 in four directions are positioned to be in contact with the housing 510, air 530 inside the housing 510 is discharged in the direction of 'X' through the through holes of the front panel 520. In this case, air inside the housing is evenly discharged from the whole front panel 520 through the plurality of through holes uniformly distributed throughout the surface of the front panel 520.

Below, it will be described that the air cleaner operates in the second mode.

Figure 6:
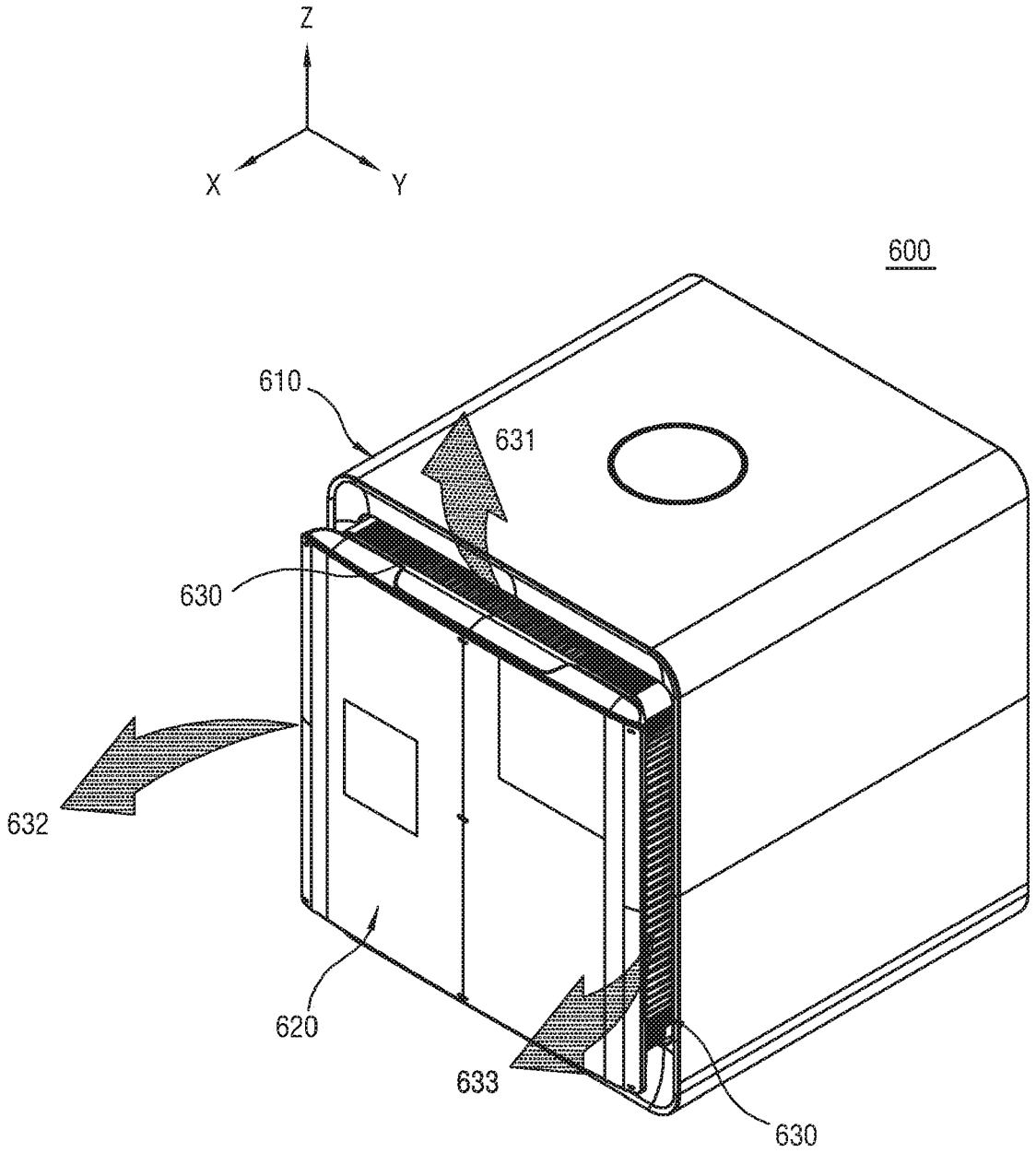
FIG. 6 is a perspective view showing an outer appearance of an air cleaner according to an embodiment of the disclosure in a second mode.

FIG. 6 is a perspective view showing an outer appearance of an air cleaner according to an embodiment of the disclosure in the second mode.

As shown in FIG. 6, an air cleaner 600 in the second mode moves a front panel 620 forward from the front of a housing 610 in the direction of 'X'. Because the whole front panel 620 is spaced apart from the outlet of the housing 610, channel guides 630 installed at the edges of the front panel 620 are opened. When the air cleaner 600 is in the first mode (see FIG. 5), the four edges of the front panel 620 are positioned to be in contact with the housing 610, and therefore the channel guide 630 is not exposed to the outside as it is closed. On the other hand, the edges of the front panel 620 are spaced apart from the housing 610 in the second mode, and therefore the channel guide 630 is exposed to the outside.

The channel guides 630 are extended along the top, left, and right edges of the front panel 620, and include a quadrangular frame having a width perpendicularly to the surface of the front panel 620, and a plurality of channels formed on the surface of the frame. The frame of the channel guide 630 is installed in the direction of '−X' to stand on the surface of the front panel 620 facing toward the inside of the housing 610.

The channel of the channel guide 630 discharges air between the housing 610 and the top, left and right edges of the front panel 620 toward the outside of the housing 610 while the front panel 620 is being spaced apart from the housing 610. There are no limits to the diameter, shape and number of channels of the channel guide 630. However, the channel of the channel guide 630 is prepared for the second mode in which the air volume is more than that in the first mode, and thus at least the diameter of the channel of the channel guide 630 is larger than that of the through hole of the front panel 620 in order to discharge relatively much air.

The channels of the channel guide 630 includes a first channel 631 between the top edge of the front panel 620 and the housing 610, a second channel 632 between the left edge of the front panel 620 and the housing 610, and a third channel 633 between the right edge of the front panel 620 and the housing 610. When the front panel 620 moves to the position spaced apart from the housing 610, the first channel 631, the second channel 632 and the third channel 633 are opened.

However, the channel guide 630 does not have a channel between the bottom edge of the front panel 620 and the housing 610. This is because dust on the floor may scatter as air discharged through the bottom channel is directly blown to a floor on which the air cleaner 600 is installed. Of course, when the air cleaner 600 is structured not to be put on the floor but to be mounted to a wall or put on a table or the like, the channel guide 630 may have the channel between the bottom edge of the front panel 620 and the housing 610.

The air cleaner 600 discharges air through the through holes of the front panel 620 even in the second mode like that is the first mode. When it is assumed that a user is generally positioned in front of the air cleaner 600, air directly blown to the user is discharged through the front panel 620 in the direction of 'X'. Regarding the directions of the channels, the first channel 631, the second channel 632 and the third channel 633 opened in the second mode are oriented in a direction perpendicular to the direction of 'X'. In the second mode, air discharged through the first channel 631, the second channel 632 and the third channel 633, which is not directly blown to a user, has a relatively high wind-speed, but air discharged through the front panel 620, which is directly blown to the user, has a relatively low wind-speed.

Thus, the air cleaner restrains the cold draft phenomenon in both the first mode and the second mode.

Below, the inner structure of the air cleaner will be described.

Figure 7:
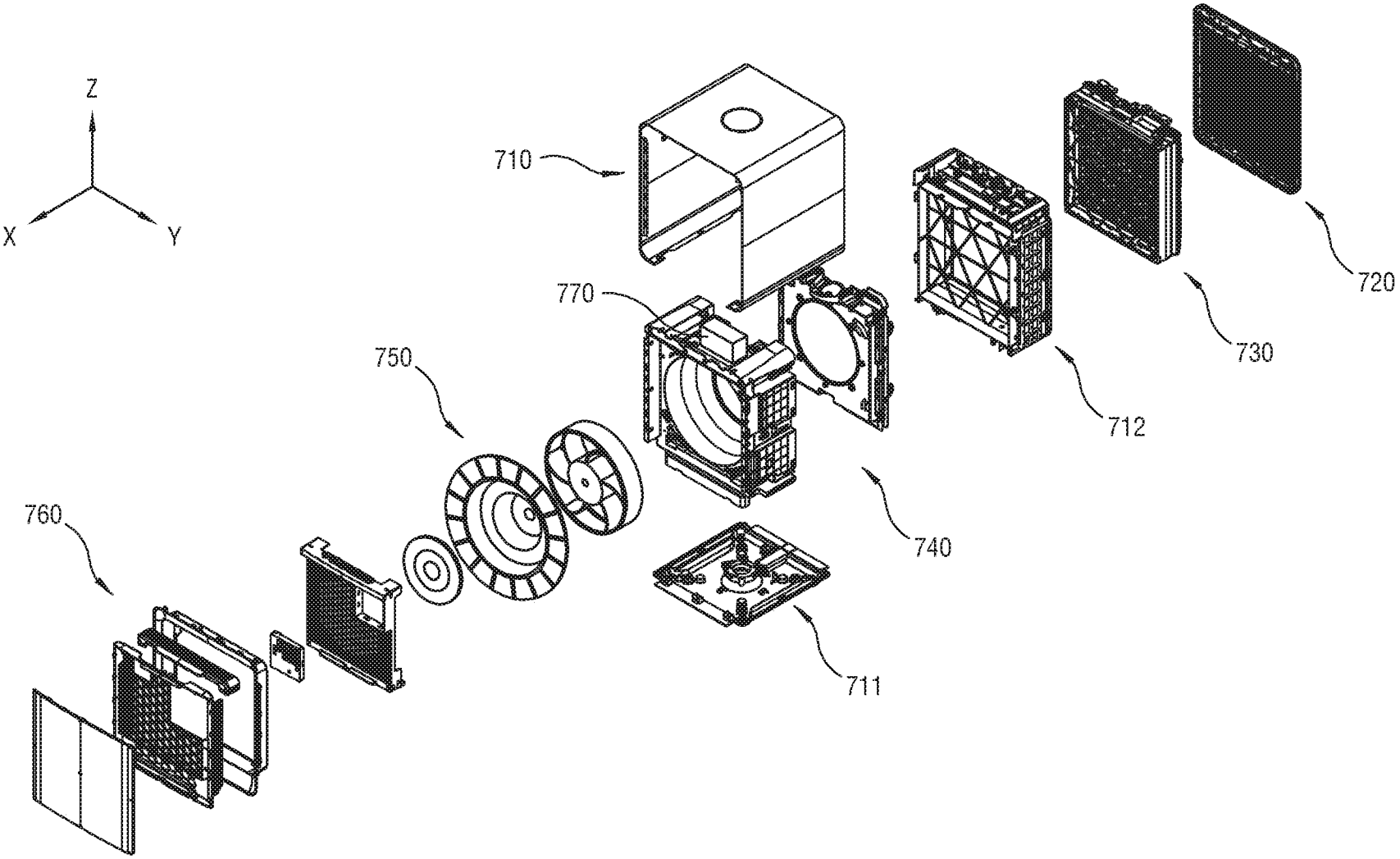
FIG. 7 is an exploded perspective view showing an inner structure of an air cleaner according to an embodiment of the disclosure.

FIG. 7 is an exploded perspective view showing an inner structure of an air cleaner according to an embodiment of the disclosure.

As shown in FIG. 7, an inner structure of an air cleaner 700 according to this embodiment will be described.

The air cleaner 700 according to this embodiment includes a housing 710 forming an outer appearance and formed with openings on the front and back thereof, a rear panel unit 720 installed in the back opening of the housing 710, a filter unit 730 accommodated in the housing 710 and filtering air introduced into the housing 710, a duct unit 740 guiding air inside the housing 710 forward, an air-blowing unit 750 moving the air, a front panel unit 760 installed in the front opening of the housing 710, and a control unit 770 controlling general operations of the air cleaner 700.

The actual product of the air cleaner 700 may include various elements in addition to such elements. However, to easily and clearly show the concept of the disclosure, descriptions will be made focusing on basic elements and elements directly related to the features of the air cleaner 700 in this embodiment.

The housing 710 is coupled onto a base 711 put on the floor, and formed with left and right panels and a top panel. The edge between the left panel and the top panel and the edge between the right panel and the top panel are rounded for convenience of use. The housing 710 includes the back opening as an air inlet, and the front opening as an air outlet. The housing 710 is internally provided with a frame 712 to which general elements of the air cleaner 700 are coupled or supported. The panels forming the housing 710 may be formed with additional openings for sucking air.

The rear panel unit 720 includes a plate for covering the back inlet of the housing 710, and at least one through hole formed on the plate. The rear panel unit 720 is coupled to the frame 712 or the housing 710, thereby covering the inlet of the housing 710 to protect the inside of the housing 710. Air outside the housing 710 is introduced into the housing 710 through the through holes of the rear panel unit 720. A plurality of through holes are uniformly distributed and arranged throughout the surface of the rear panel unit 720, thereby uniformly introducing external air.

The filter unit 730 includes one or more filters, of which surfaces are arranged perpendicularly to the direction of 'X'. When the filter unit 730 includes a plurality of filters, the plurality of filters are arranged in sequence along the direction of 'X', so that air moving in the direction of 'X' can pass through the filters. Each filter of the filter unit 730 includes a filter member for purifying air by interaction with the air, and a filter frame supporting the filter member. The kinds of filters in the filter unit 730 depend on the characteristics of the filter member, and the filter unit 730 may be designed to include a plurality of filters different in characteristics from each other.

The filter of the filter unit 730 serves to collect dust from air, remove bad smells, purify gas, perform sterilization, etc. For example, the filter unit 730 may include at least one of a prefilter of which lattices are comparatively large to filter out dust of relatively big particles, a dust-collection filter to collect fine dust, a deodorant filter provided with granular activated carbon or the like to remove bad smells, and a sterilization filter provided with an active oxygen layer or the like for sterilization.

Each individual filter of the filter unit 730 is separable from the housing 710 or the frame 712, and it is thus possible to individually replace or clean the filters.

The duct unit 740 guides air introduced into the housing 710 to move forward from the housing 710 by the air-blowing unit 750. The duct unit 740 is provided in front of the filter unit 730 within the housing 710, and guides purified air passed through the filter unit 730 to the outlet in the front of the housing 710. The air-blowing unit 750 is provided in front of the duct unit 740, and the inside of the duct unit 740 is shaped like a circle corresponding to the outer appearance of the air-blowing unit 750.

The air-blowing unit 750 includes a motor, and an air-blowing fan which is driven by the motor to revolve based on a predetermined number of revolution times per unit time and form airflow. The air-blowing unit 750 is provided in front of the duct unit 740, sucks air outside the housing 710 into the housing 710, and moves air purified passing through the filter unit 730 toward the outlet provided in the front of the housing 710. The air-blowing unit 750 may send air in various directions according to the structures of the air-blowing fan. According to this embodiment, the air-blowing unit 750 is provided to move the air in the direction of 'X'. Further, the air-blowing unit 750 is provided to stop and operate and to change speed under control of the control unit 770.

The front panel unit 760 covers the outlet in the front of the housing 710. The front panel unit 760 includes a front panel, a channel guide provided on the rear surface of the front panel, a grill plate provided behind the front panel, and a front panel driver for driving the front panel to move with respect to the housing 710 under control of the control unit 770. Among the elements of the front panel unit 760, the front panel and the channel guide are the same as described above.

The control unit 770 is embodied by a circuit on a printed circuit board (PCB) with electronic parts such as a chipset, a processor, a control processing unit (CPU), a memory, etc. The control unit 770 is provided on the duct unit 740 or the frame 712 inside the housing 710, and transmits a control signal to the air-blowing unit 750, the front panel unit 760, and the like elements which need driving control. Below, a driving control method of the control unit 770 will be described in detail.

Figure 8:
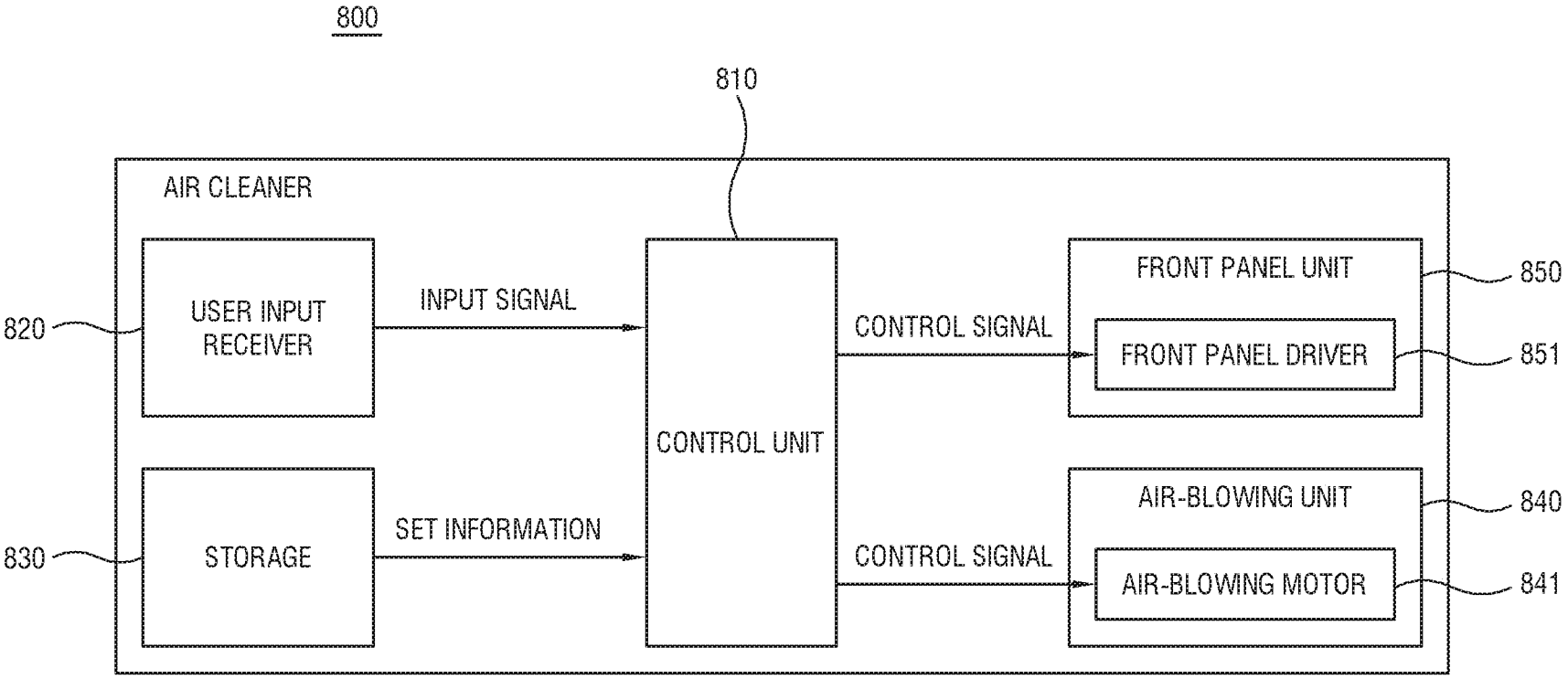
FIG. 8 is a block diagram showing a control structure of an air cleaner according to an embodiment of the disclosure.

FIG. 8 is a block diagram showing a control structure of an air cleaner according to an embodiment of the disclosure.

As shown in FIG. 8, an air cleaner 800 carries out control operation of the air cleaner 800 by a control unit 810. When occurrence of a predetermined event is detected, the control unit 810 implements operation corresponding to the event. For example, such an event may be based on an input signal received through a user input receiver 820, or may be directed by previously stored scheduling information.

When the event is directed to a predetermined operation mode, the control unit 810 obtains setting information corresponding to the directed mode from a storage 830. The setting information may for example include a speed of an air-blowing fan of an air-blowing unit 840, a parameter of a position or the like for the front panel of a front panel unit 850, or data of a control signal corresponding to such a parameter, in the corresponding mode.

The control unit 810 transmits control signals based on the setting information obtained from the storage 830 to an air-blowing motor 841 or a front panel driver 851, thereby controlling the operation of the air-blowing unit 840 or front panel unit 850. The control signal may include a signal having a preset voltage level, or a signal distinguished between high and low.

For example, the setting information stored in the storage 830 may be set with a low level for the first mode and a high level for the second mode to control the front panel driver 851. Based on the setting information, the control unit 810 transmits a signal having the low level to the front panel driver 851 when the event directed to the first mode is received, but transmits a signal having the high level to the front panel driver 851 when the event directed to the second mode is received.

Like this, the control unit 810 can control the operation of the air cleaner 800.

Below, the structure and operation method of the front panel unit will be described in more detail.

Figure 9:
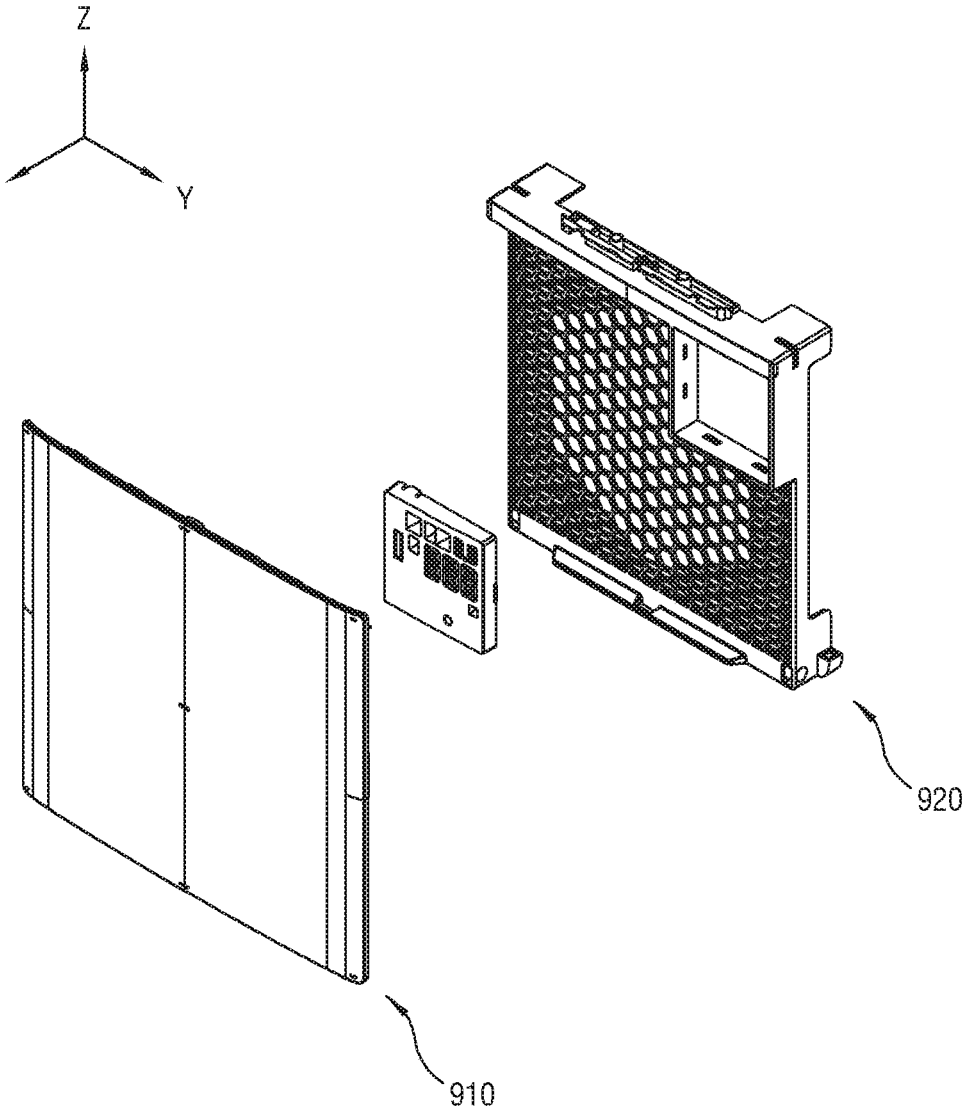
FIG. 9 is a perspective view showing a front panel and a grill plate in an air cleaner according to an embodiment of the disclosure.

FIG. 9 is a perspective view showing a front panel and a grill plate in an air cleaner according to an embodiment of the disclosure.

As shown in FIG. 9, a front panel unit of an air cleaner includes a front panel 910, and a grill plate 920 accommodated in a housing and disposed behind the front panel 910. The front panel 910 is the same as described in the foregoing embodiments.

The grill plate 920 is disposed in parallel with the front panel 910, and includes a plate throughout which a plurality of through holes is uniformly formed. Air sent from the air-blowing unit is discharged to the outside of the housing by passing through the through holes of the grill plate 920 and then passing through the through holes of the front panel 910.

The diameter of the through hole of the grill plate 920 is not limited to a specific numerical value. However, the through hole of the grill plate 920 has a larger diameter than the through hole of the front panel 910. Air is distributed passing through the plurality of through holes of the grill plate 920 having a comparatively large diameter, and then discharged passing through the through holes of the front panel 910 having a comparatively small diameter. In other words, the diameter of the through hole of the grill plate 920 is relatively large, and therefore air moving toward the front panel 910 is uniformly distributed throughout the front panel 910.

According to design methods, one or more grill plates 920 may be provided and coupled to the housing or the front panel 910. As the number of grill plates 920 increases, air is more uniformly distributed throughout the surface of the front panel 910 but interference with flow of air increases.

When the grill plate 920 is coupled to the housing, a distance between the front panel 910 and the grill plate 920 is changed by the movement of the front panel 910. In this case, air-distribution performance of the grill plate 920 may be varied depending on the positions of the front panel 910.

Meanwhile, when the grill plate 920 is coupled to the back of the front panel 910, the hardness of the front panel 910 may generally be reinforced. Because fine through-holes are formed throughout the surface of the front panel 910, the front panel 910 is easily bent or twisted by external force. Thus, the grill plate 920 is coupled to the front panel 910 and supports the front panel 910, thereby preventing the front panel 910 from deformation.

Below, a structure for moving the front panel 910 with respect to the housing will be described.

Figure 10:
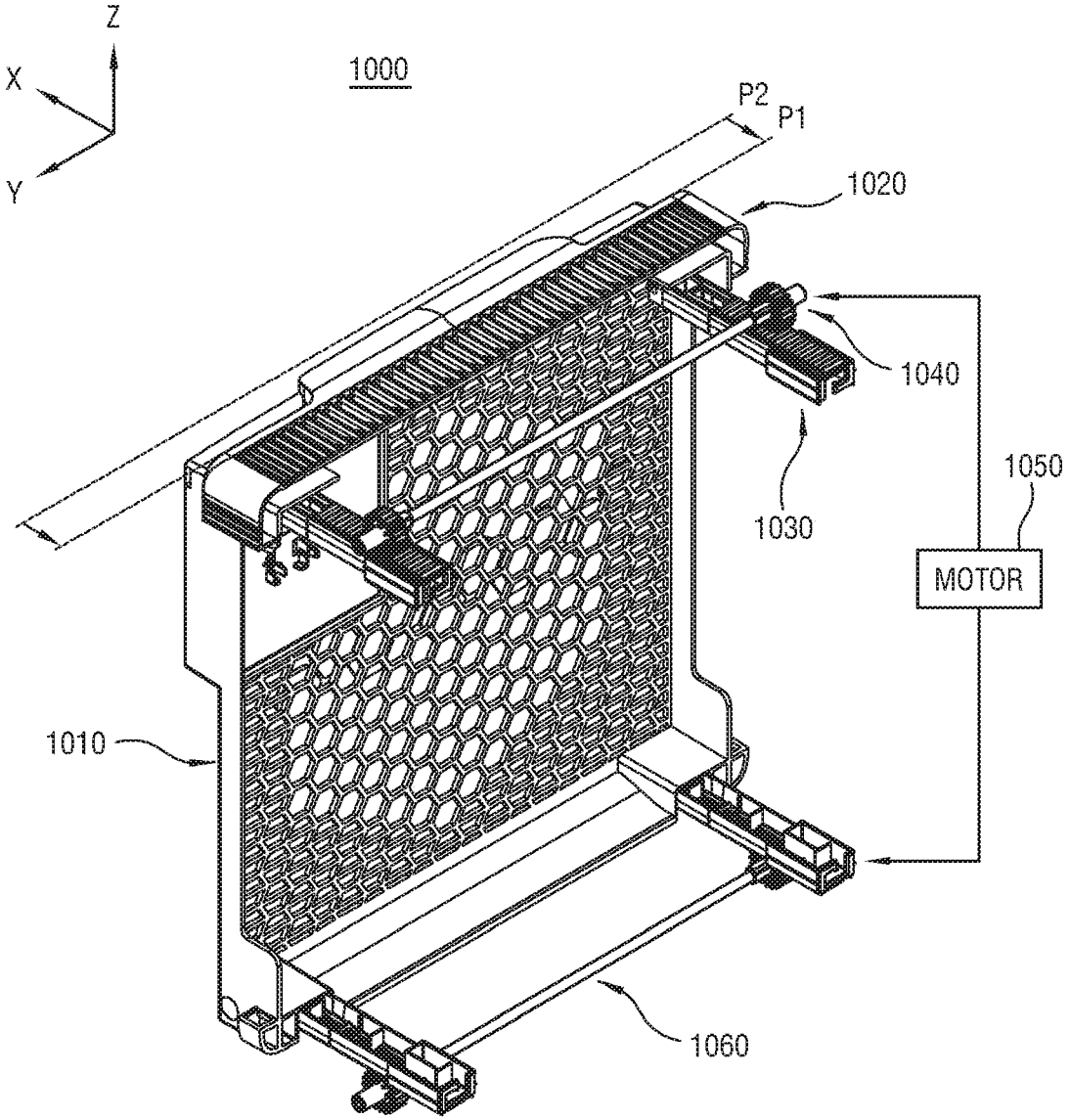
FIG. 10 is a perspective view showing a structure when a front panel of an air cleaner according to an embodiment of the disclosure is in a closed position.

FIG. 10 is a perspective view showing a structure when a front panel of an air cleaner according to an embodiment of the disclosure is in a closed position.

As shown in FIG. 10, a front panel unit 1000 includes a front panel 1010, a channel guide 1020 coupled to the back of the front panel 1010, a rack 1030 extended from the back of the front panel 1010 toward the inside of the housing, a pinion 1040 rotatably coupled to the housing and meshed with the rack, and a motor 1050 driving the pinion 1040 to rotate in forward and backward directions.

In this embodiment, the rack 1030 is provided corresponding to each of four vertexes of the front panel 1010, and thus there are a total of four racks 1030. It will be described that two links 1060 for transmitting the rotary power of the motor 1050 are provided by connecting the two upper pinions 1040 and connecting the two lower pinions 1040. However, the features about the number and positions of racks 1030, the presence of the link 1060 for connecting the plurality of pinions 1040, etc. are freely designable by workshop modification in terms of embodying the concept of the disclosure, and thus do not limit the concept of the disclosure.

The rack 1030 is shaped like a bar extended along an axis in the direction of '−X', and includes a gear formed on one side thereof along a lengthwise direction. The pinion 1040 is shaped like a disc having a predetermined thickness, and includes a gear formed on an outer circumferential wall thereof to be in contact with the rack 1030. When the pinion 1040 rotates in a state that the gear of the rack 1030 is meshed with the gear of the pinion 1040, the rack 1030 moves in the forward direction or the backward direction. Then, based on the movement of the rack 1030, the front panel 1010 moves in the forward direction or the backward direction.

When an event directed to the first mode occurs, the motor 1050 drives the pinion 1040 to rotate in the forward direction under control of the control unit. As the pinion 1040 rotates in the forward direction, the rack 1030 moves in in the direction of '−X', and thus the front panel 1010 coupled to the rack 1030 moves to a first position P1. The first position P1 refers to a closed position where the front panel 1010 closes the outlet of the housing and the channel guide 1020 retracts into the housing.

When the front panel 1010 is in the closed position, the through holes of the channel guide 1020 are not exposed to the outside, and therefore air inside the housing is discharged via not the through holes of the channel guide 1020 but only the through holes of the front panel 1010.

Below, a case where an event for switching over from the first mode to the second mode occurs will be described.

Figure 11:
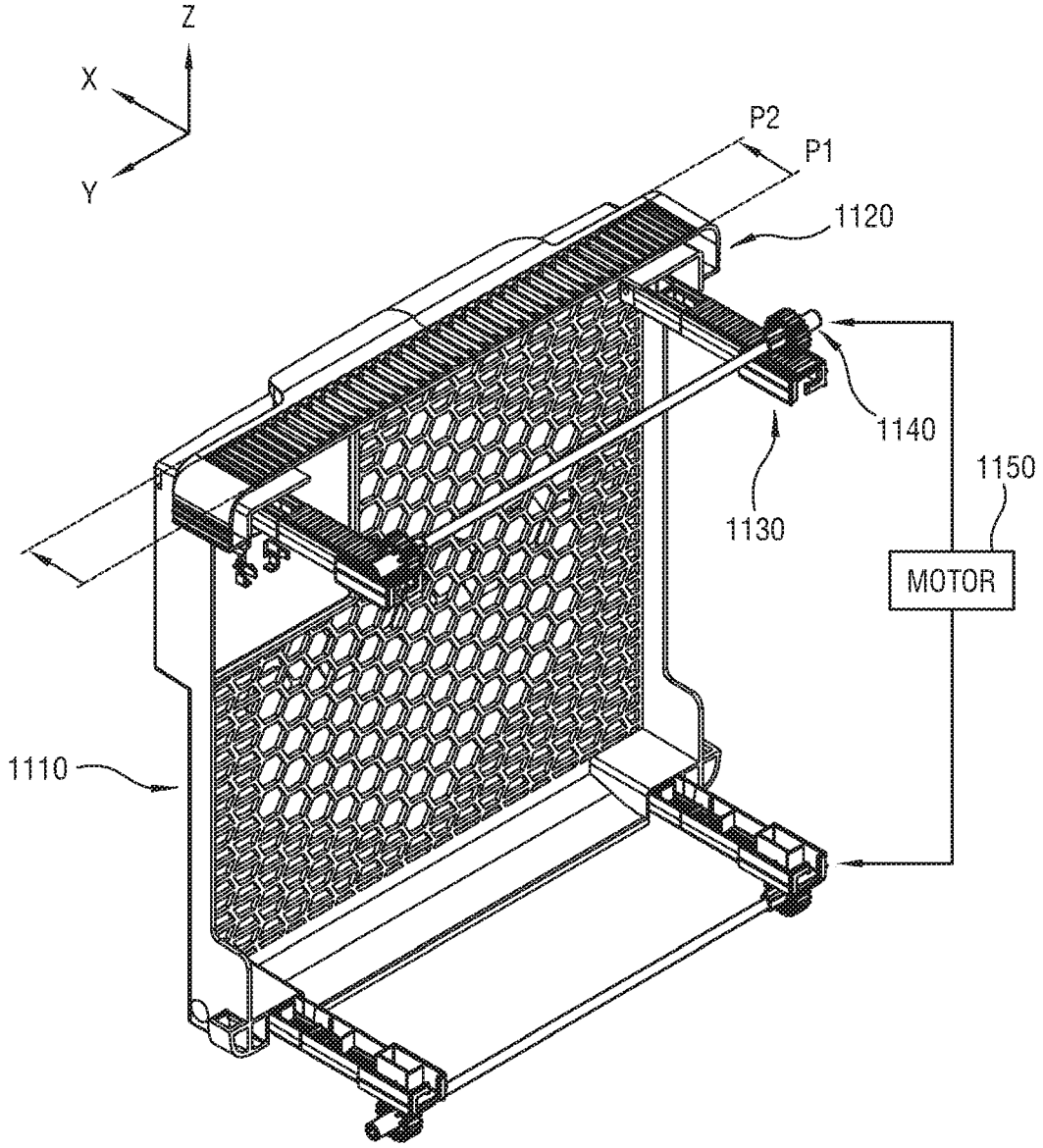
FIG. 11 is a perspective view showing a structure when a front panel of an air cleaner according to an embodiment of the disclosure is in an open position.

FIG. 11 is a perspective view showing a structure when a front panel of an air cleaner according to an embodiment of the disclosure is in an open position.

As shown in FIG. 11, when an event directed to the second mode occurs, a motor 1150 drives a pinion 1140 to rotate in the backward direction under control of the control unit. As the pinion 1140 rotates in the backward direction, a rack 1130 moves in the direction of 'X', and thus a front panel 1110 coupled to the rack 1130 moves to a second position P2. The second position P2 refers to an opened position where the front panel 1110 opens the outlet of the housing and the channel guide 1120 is exposed to the outside of the housing.

When the front panel 1110 is in the opened position, the through holes of the channel guide 1120 are exposed to the outside, and therefore air inside the housing is mainly discharged via the through holes of the channel guide 1120 and partially discharged via the through holes of the front panel 1110.

With such a structure and method, the air cleaner moves the front panel 1110 so that the position of the front panel 1110 can be controlled according to the modes.

In addition, the air cleaner may include a sensor for detecting that a user comes close to the air cleaner. In this case, the air cleaner stops moving the front panel 1110 when the sensor detects that a user comes within a predetermined range while the front panel 1110 is moving. The air cleaner resumes moving the front panel 110 when the sensor detects that a user goes out of a predetermined range while the front panel 110 is stopped.

In the foregoing embodiment, the through holes of the channel guide 1120 are opened and closed by moving the front panel 1110. However, the structure of opening or closing the through holes of the channel guide 1120 is not limited to that of the foregoing embodiment, and another structure will be described below.

Figure 12:
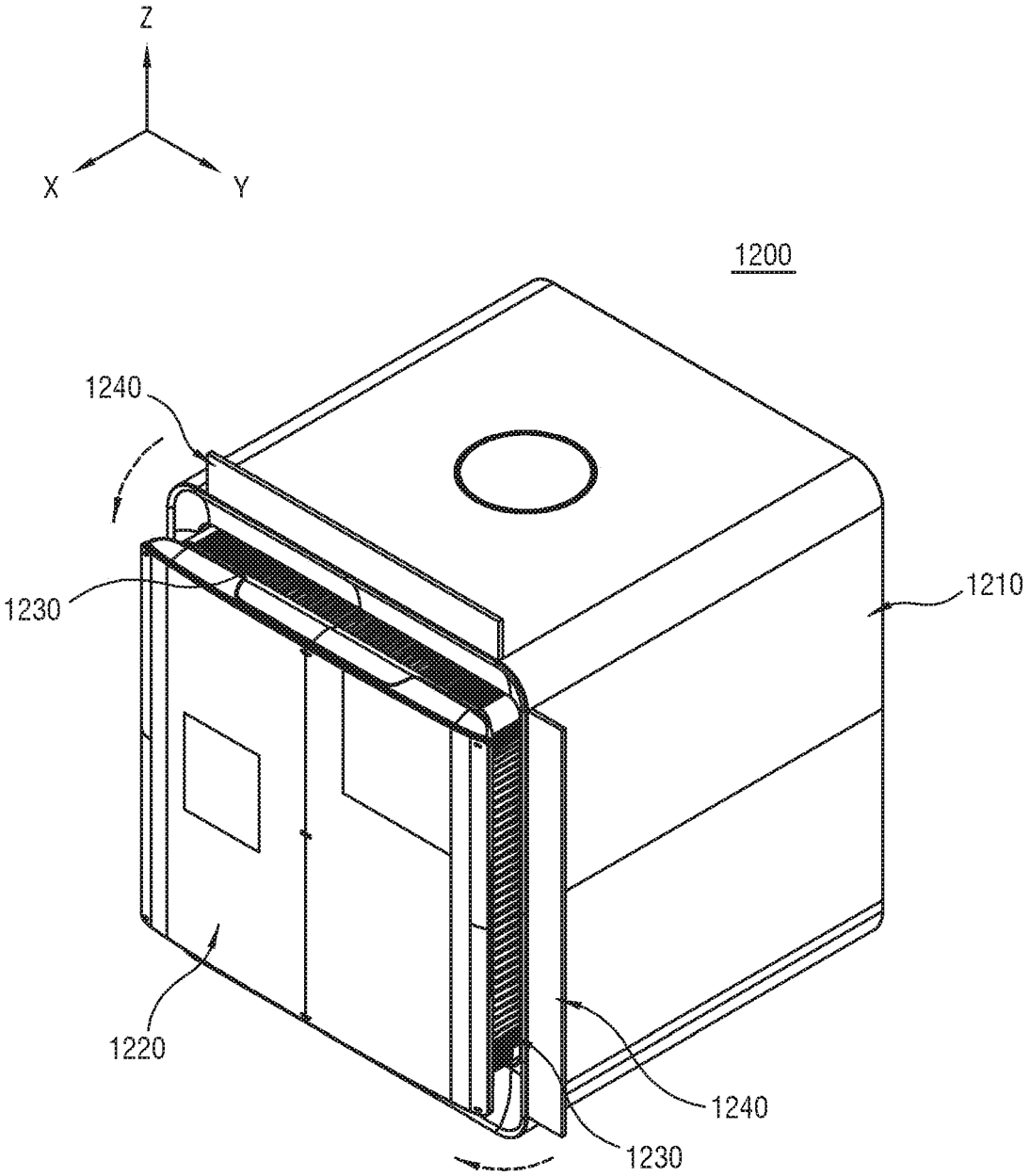
FIG. 12 is a perspective view showing an opened outlet door in an air cleaner according to an embodiment of the disclosure.

FIG. 12 is a perspective view showing an opened outlet door in an air cleaner according to an embodiment of the disclosure.

As shown in FIG. 12, an air cleaner 1200 includes a housing 1210, a front panel 1220 covering a front opening of the housing 1210 and formed with a plurality of through holes, an outlet 1230 formed between the housing 1210 and the edge of the front panel 1220, and an outlet door 1240 rotatable to selectively open or close the outlet 1230.

This embodiment and the foregoing embodiment are the same in that the front panel 1220 includes the plurality of through holes via which air is discharged, but different in that the front panel 1220 does not move to change the position with respect to the housing 1210. Air inside the housing 1210 is discharged via the through holes of the front panel 1220 in the direction of 'X'.

The outlets 1230 are provided between the top edge of the front panel 1220 and the housing 1210, between the left edge of the front panel 1220 and the housing 1210, and between the right edge of the front panel 1220 and the housing 1210. The outlet 1230 discharges air inside the housing 1210 in directions perpendicular to the surface of the front panel 1220, for example, the direction of 'Z', the direction of 'Y', and the direction of '−Y'.

The outlet door 1240 is provided as a plate extended along the outlet 1230, and includes one side rotatably connected to the housing 1210. For example, the outlet door 1240 is rotatably coupled to the housing 1210 by a hinge, and the hinge is connected to a rotary shaft of a motor and driven by the motor to rotate to a predetermined position. The rotation of the outlet door 1240 is carried out as the control unit controls the motor.

The outlet door 1240 may rotate between a closed position for closing the outlet 1230 and an opened position for opening the outlet 1230. For example, the outlet door 1240 is moved to the closed position in the first mode, thereby preventing air inside the housing 1210 from being discharged through the outlet 1230 and allowing air inside the housing 1210 to be discharged through only the front panel 1220. On the other hand, the outlet door 1240 is moved to the opened position in the second mode, thereby allowing air inside the housing 1210 be discharged through the outlet 1230.

Alternatively, the outlet door 1240 may be designed to be coupled to not the housing 1210 but the front panel 1220. In this case, the outlet door 1240 coupled to the front panel 1220 rotates in the opposite direction to the outlet door 1240 coupled to the housing 1210. Further, in this case, a motor for rotating the outlet door 1240 may be provided in the housing 1210 or the front panel 1220.

Thus, the air cleaner 1220 according to this embodiment has a structure for selectively closing the outlet 1230 based on the rotation of the outlet door 1240 instead of the movement of the front panel 1220.

Meanwhile, the air cleaner may enter the first mode, i.e. a low wind-speed mode, in which air volume and wind speed are lower than those of the second mode, i.e. the normal wind mode, based on various methods as well as a user's input. Below, a condition for entering the first mode will be described.

Figure 13:
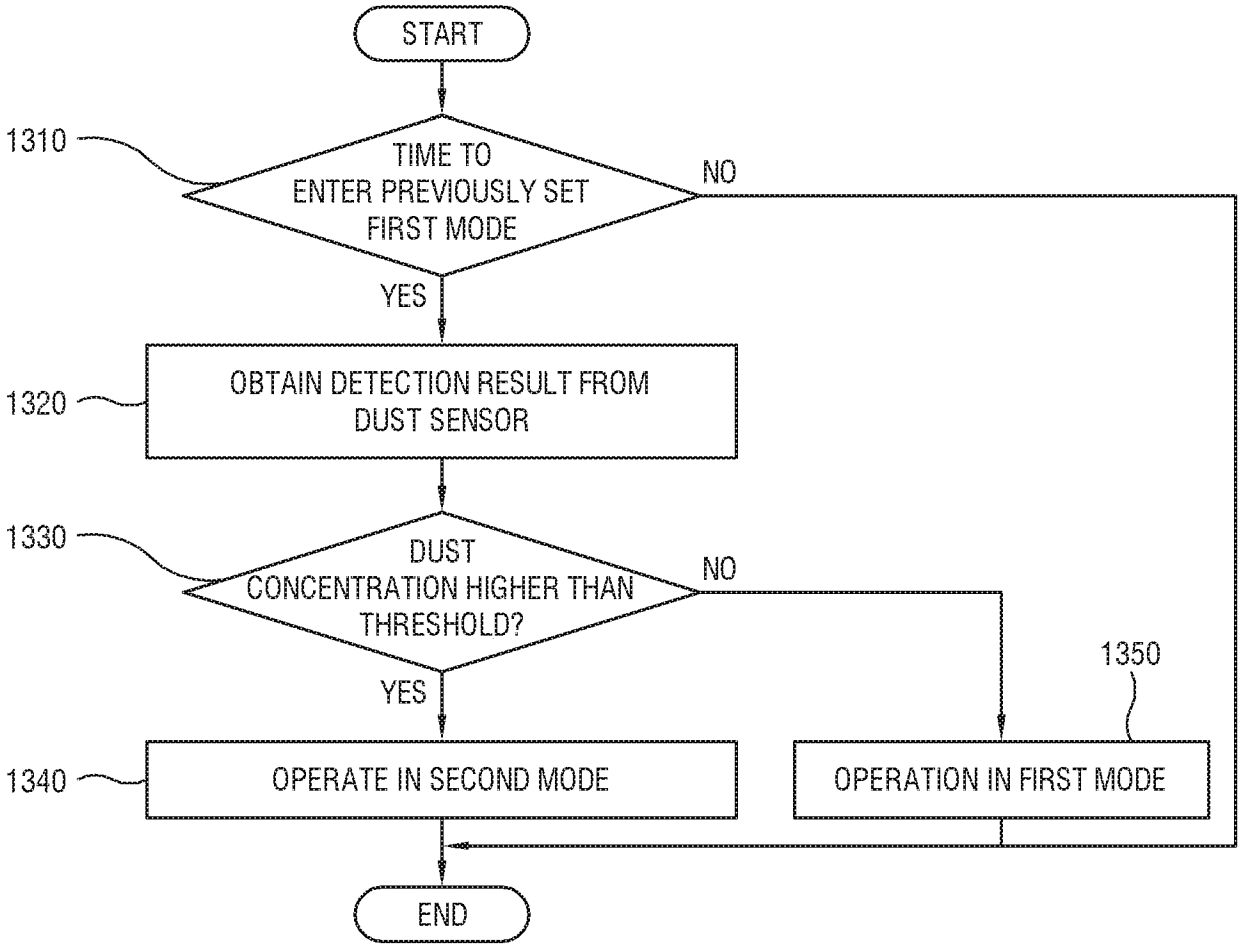
FIG. 13 is a flowchart showing a method that an air cleaner according to an embodiment of the disclosure enters a first mode.

FIG. 13 is a flowchart showing a method that an air cleaner according to an embodiment of the disclosure enters a first mode.

As shown in FIG. 13, the following operations of the air cleaner are carried out by the control unit.

At operation 1310 the air cleaner identifies whether the current time is time to enter the first mode as set in previously stored scheduling information. When the current time is not the set time to enter the first mode, the air cleaner continues to measure time.

The scheduling information is previously scheduled to set the air cleaner to automatically enter the first mode at a specific time. For example, when a user makes a user input to direct the air cleaner to enter the first mode at nine every night, the air cleaner stores the directions of the user input as the scheduling information, and automatically enters the first mode when it reaches the time set in the scheduling information. The user input may be made through a UI provided in the air cleaner, or in an external apparatus such as a mobile apparatus that communicates with the air cleaner. The air cleaner may autonomously have a clock to identify the current time, or may periodically obtain time information from another external apparatus under Internet-of-Things (IoT) environments.

When the current time is the set time, at operation 1320 the air cleaner obtains a detection result from a dust sensor. The dust sensor measures a dust concentration in the use environment of the air cleaner.

At operation 1330 the air cleaner identifies whether the dust concentration is higher than a predetermined threshold.

When the dust concentration is higher than the threshold, at operation 1340 the air cleaner operates in the second mode even though it is time enter the first mode as set in the scheduling information.

On the other hand, when the concentration is not higher than the threshold, at operation 1350 the air cleaner operates in the first mode as set in the scheduling information.

Like this, in terms of automatically entering the first mode at the time set in the scheduling information, the air cleaner according to this embodiment may selectively operate in the first mode or the second mode based on whether the dust concentration is high in the use environment.

Further, the air cleaner may set time to enter or release the first mode based on learning and automatically perform entering or releasing the first mode. Such an embodiment will be described below.

Figure 14:
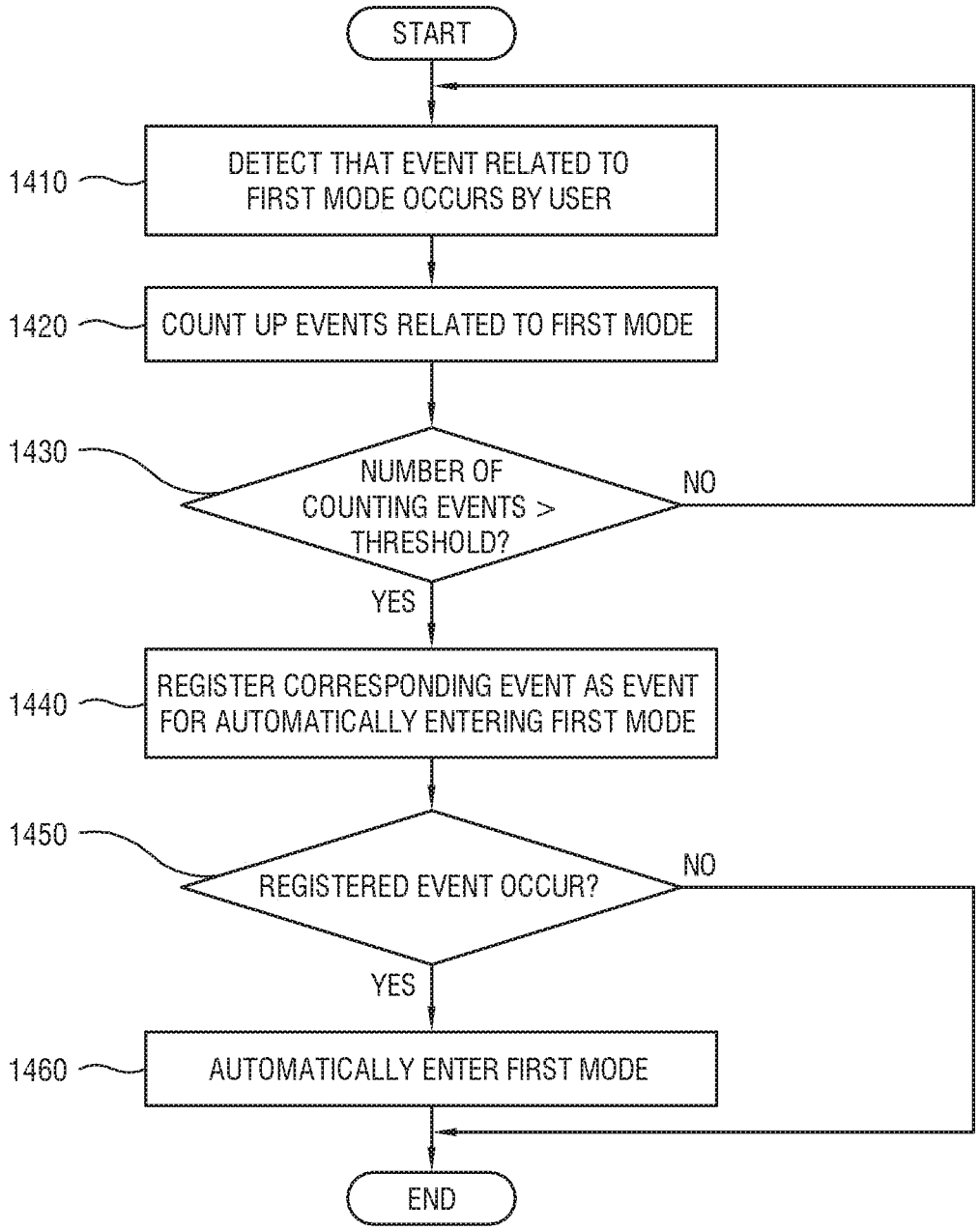
FIG. 14 is a flowchart showing a method that an air cleaner according to an embodiment of the disclosure identifies time to enter a first mode through learning.

FIG. 14 is a flowchart showing a method that an air cleaner according to an embodiment of the disclosure identifies time to enter a first mode through learning.

As shown in FIG. 14, the following operations of the air cleaner are carried out by the control unit.

At operation 1410 detects that an event related to the first mode occurs by a user. There may be various types of event. For example, a user may set the air cleaner to enter the first mode at a specific time every day, when a predetermined period of time elapses after the air cleaner is turned on, when a window is opened, or when a light is turned off in a room. When the air cleaner is capable of communicating with other things under an IoT environment, the air cleaner may obtain information about a current state from various things such as a light, a window, a shutter, a home appliance, an electronic apparatus, a wearable device, a mobile apparatus, etc.

At operation 1420 the air cleaner counts up the events related to the first mode. For example, a user may make an input directed to the first mode within a preset period of time after an indoor light is turned off, and the air cleaner counts up such events.

At operation 1430 the air cleaner identifies whether the number of counting events is greater than a predetermined threshold. When the number of counting events is not greater than the threshold, the air cleaner continues to monitor whether the event occurs.

When the number of counting events is greater than the threshold, at operation 1440 the air cleaner registers the corresponding event as an event that makes the air cleaner automatically enter the first mode.

At operation 1450 the air cleaner identifies whether a previously registered event occurs. When the previously registered event does not occur, the air cleaner does not perform any specific operation.

When the previously registered event occurs, at operation 1460 the air cleaner automatically enters the first mode regardless of a user's input.

Meanwhile, when the air cleaner registers the event to automatically enter the first mode, a UI related to registration may be displayed through the display and the like interface, or relevant information may be transmitted to an external apparatus through the communicator so that a UI can be displayed on a mobile apparatus and the like external apparatus. The air cleaner may register the corresponding event when the event is approved by a user through the UI, and may nor register the event when the event is not approved by the user.

Thus, the air cleaner may register the events to automatically enter the first mode, based on learning. This embodiment shows that the air cleaner enters the first mode. Alternatively, the sample principle may be applied even when the air cleaner releases the first mode.

This embodiment shows that the air cleaner automatically enters the first mode based on detection results of dust concentration. However, such an automatic operation may be restricted according to whether it is set by a user, and such an embodiment will be described below.

Figure 15:
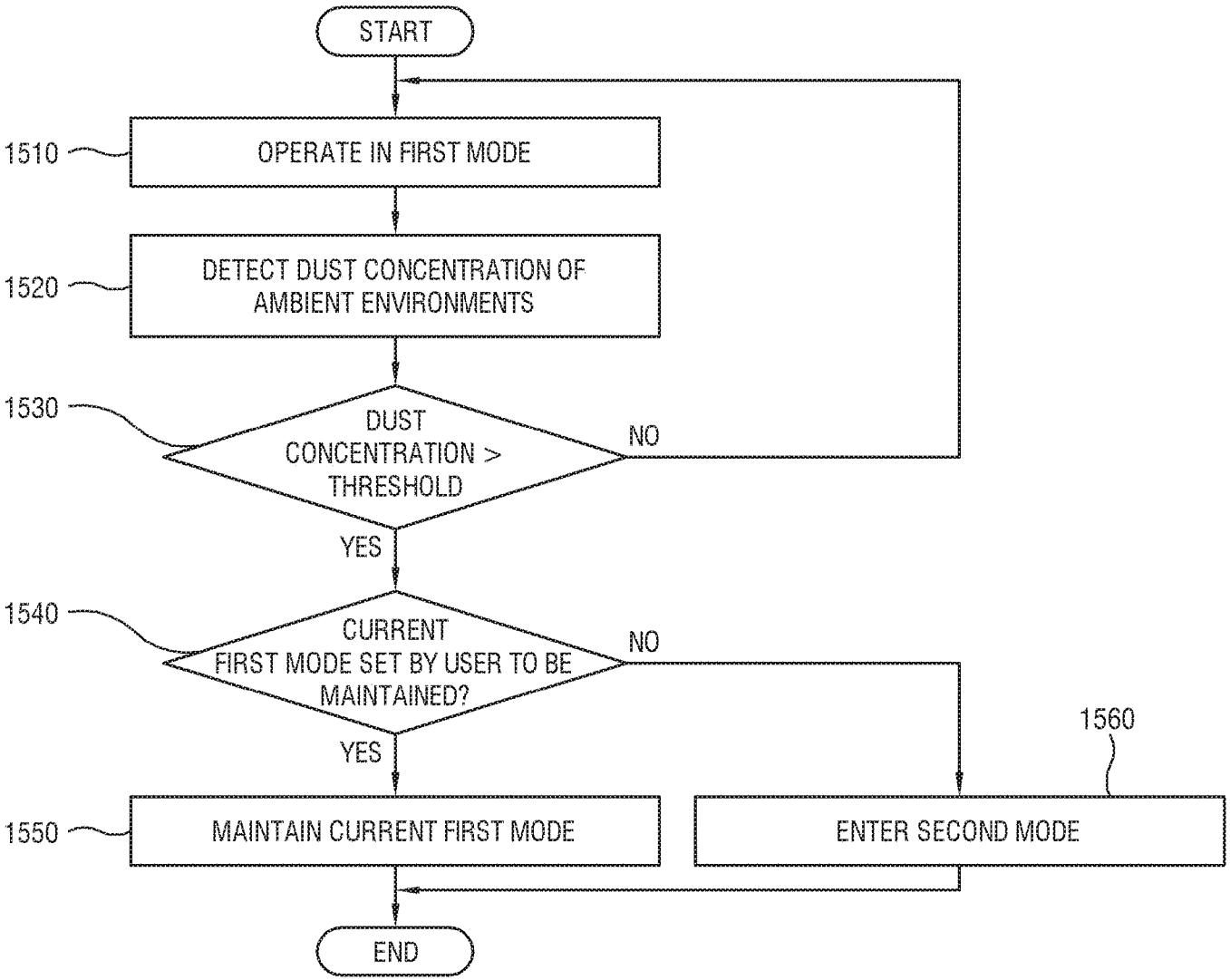
FIG. 15 is a flowchart showing a control method of an air cleaner according to an embodiment of the disclosure.

FIG. 15 is a flowchart showing a control method of an air cleaner according to an embodiment of the disclosure.

As shown in FIG. 15, the following operations of the air cleaner are carried out by the control unit.

At operation 1510 the air cleaner operates in the first mode.

At operation 1520 a sensor of the air cleaner detects dust concentration of ambient environments.

At operation 1530 the air cleaner identifies whether the dust concentration detected by the sensor is higher than a threshold. When the dust concentration is not higher than the threshold, the air cleaner maintains the current first mode.

When the dust concentration is higher than the threshold, at operation 1540 the air cleaner identifies whether the current first mode has been set by a user to be maintained.

When it is identified that the current first mode is set to be maintained, at operation 1550 the air cleaner maintains the current first mode without entering the second mode.

On the other hand, when it is identified that the first mode is set not to be maintained, at operation 1560 the air cleaner enters the second mode.

Like this, when a user has previously set the first mode to be maintained even though the dust concentration is higher than the threshold, the air cleaner maintains the first mode without switching over to the second mode.

Meanwhile, the foregoing embodiments show the structure that the whole front panel is moved with respect to the housing in the air cleaner. However, the front panel may be designed to have a structure different from those of the foregoing embodiments, and such an embodiment will be described below.

Figure 16:
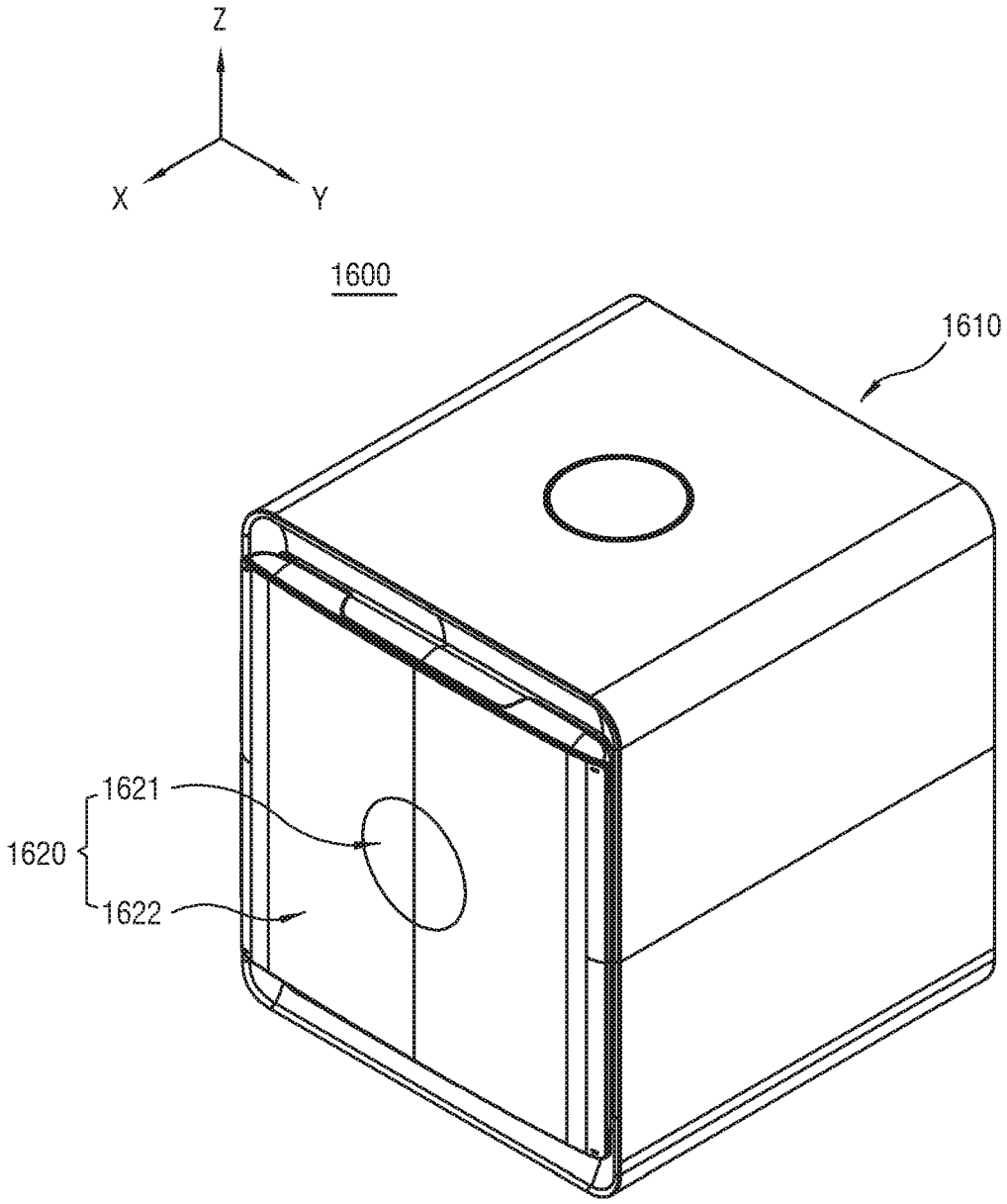
FIG. 16 is a perspective view showing that an air cleaner according to another embodiment of the disclosure operates in a first mode.

FIG. 16 is a perspective view showing that an air cleaner according to another embodiment of the disclosure operates in a first mode.

As shown in FIG. 16, an air cleaner 1600 includes a housing 1610, and a front panel 1620 provided in an outlet in the front of the housing 1610. The basic structure of the air cleaner 1600 according to this embodiment is equivalent to those of the foregoing embodiments, and thus detailed descriptions thereof will be omitted. In this embodiment, the air cleaner 1600 will be described focusing on different structures from those of the foregoing embodiments.

The front panel 1620 includes a first panel 1621, and a second panel 1622 separated from the first panel 1621. The first panel 1621 is a circular panel disposed at the center of the front panel 1620. On the other hand, the second panel 1622 is a quadrangular panel disposed to surround the circumference of the first panel 1621 and formed with a hole at the center thereof. In FIG. 16, the first panel 1621 is disposed in the central hole of the second panel 1622.

In the front panel 1620, the positions and shapes of the first panel 1621 and the second panel 1622 may be variously designed by workshop modification, and therefore this embodiment does not limit the concept of the disclosure. For example, the first panel may be provided as a polygonal panel. Further, the second panel may not be disposed to surround the circumference of the first panel. Alternatively, the first panel may form the upper side of the front panel, and the second panel may form the lower side of the front panel.

The front panel 1620 in this embodiment is formed with many holes on the surface thereof like those of the foregoing embodiments. There are three structures for many holes: a structure where the first panel 1621 has many holes but the second panel 1622 does not have many holes; a structure where the first panel 1621 does not have many holes and the second panel 1622 has many holes; and a structure where both the first panel 1621 and the second panel 1622 have many holes. Many holes formed in at least one of the first panel 1621 and the second panel 1622 are equivalent to the through holes of the foregoing embodiment, and thus detailed descriptions thereof will be omitted.

When the air cleaner 1600 operates in the first mode of a relatively low wind-speed among a plurality of operation modes, the front panel 1620 including the first panel 1621 and the second panel 1622 is positioned to close the outlet in the front of the housing 1610. In this case, air inside the housing 1610 is discharged through many holes of the front panel 1620, i.e. through many holes formed in at least one of the first panel 1621 and the second panel 1622.

Figure 17:
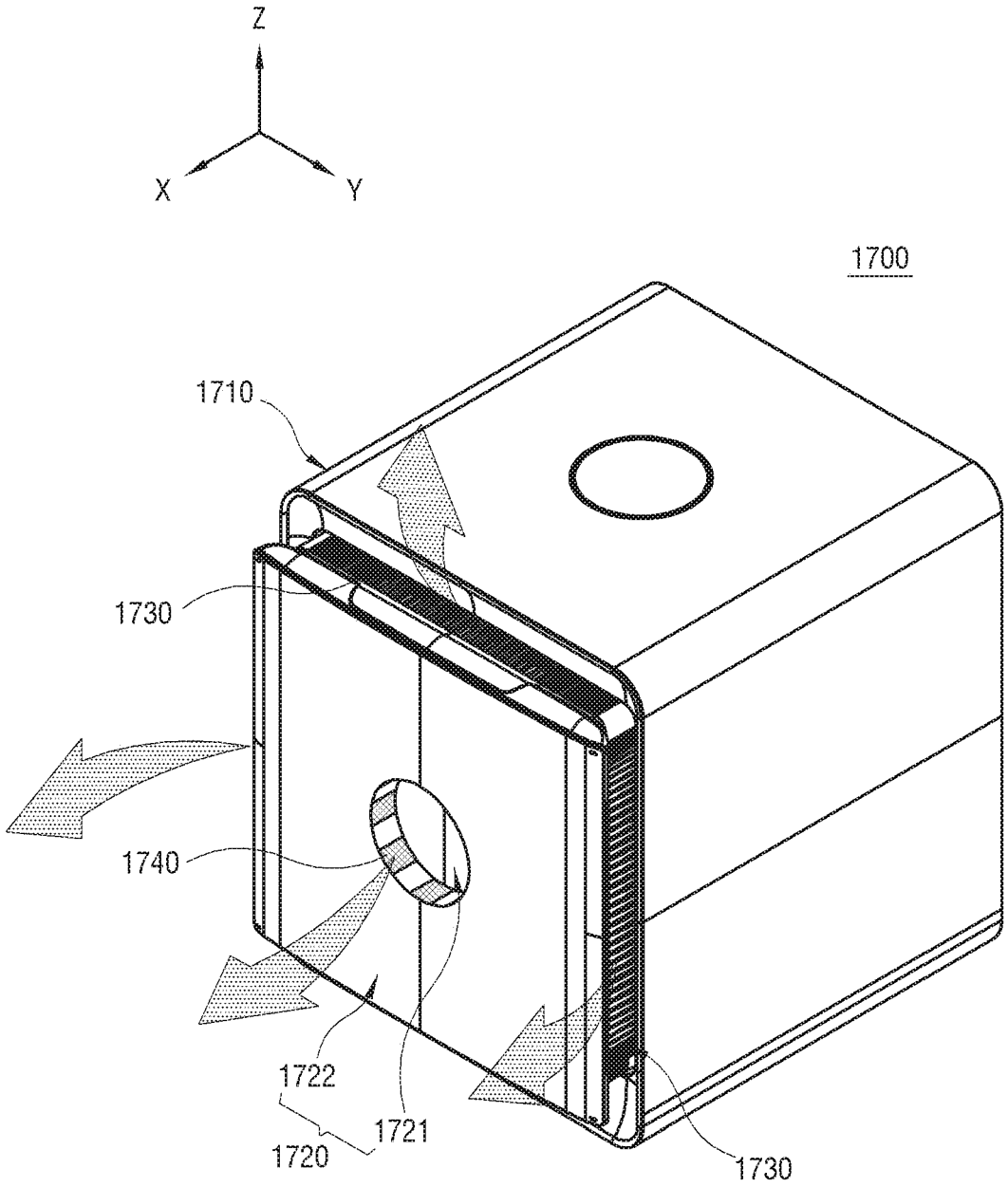
FIG. 17 is a perspective view showing that an air cleaner according to another embodiment of the disclosure operates in a second mode.

Below, it will be described that the air cleaner 1600 operates in the second mode of a relatively high wind-speed among the plurality of operation modes FIG. 17 is a perspective view showing that an air cleaner according to another embodiment of the disclosure operates in a second mode.

As shown in FIG. 17, an air cleaner 1700 includes a housing 1710, and a front panel 1720 installed in the outlet of the housing 1710. The front panel 1720 includes a first panel 1721 and the second panel 1722, which are equivalent to those of the previous embodiment.

Here, in the air cleaner 1700 according to this embodiment, the first panel 1721 is stationarily coupled to or supported by the housing 1710, but the second panel 1722 is movably provided. The movable structure for the second panel 1722 may be based on the movable structure for the front panel in the previous embodiment.

When the air cleaner 1700 enters the second mode, the first panel 1721 does not move, but the second panel 1722 moves forward from the housing 1710 in the direction of 'X' so as to be spaced from the housing 1710, thereby opening a first channel 1730 formed between the edge of the second panel 1722 and the housing 1710, and a second channel 1740 formed between the first panel 1721 and the second panel 1722. Here, it may be designed to provide only one of the first channel 1730 and the second channel 1740.

As the first channel 1730 and the second channel 1740 are opened, air inside the housing 1710 is discharged through the first channel 1730 and the second channel 1740 in the second mode. Of course, some air inside the housing 1710 may be discharged through many holes formed in the front panel 1720.

When an event directed to the first mode occurs while the air cleaner 1700 is operating in the second mode, the second panel 1722 moves in the direction of '−X', thereby closing the first channel 1730 and the second channel 1740.

Like this, the front panel 1720 of the air cleaner 1700 may be divided into a plurality of panels 1721 and 1722, and only some of the plurality of panels 1721 and 1722 may be movable.

When the air cleaner according to the foregoing embodiments is used, it has effects as follows.

Figure 18:
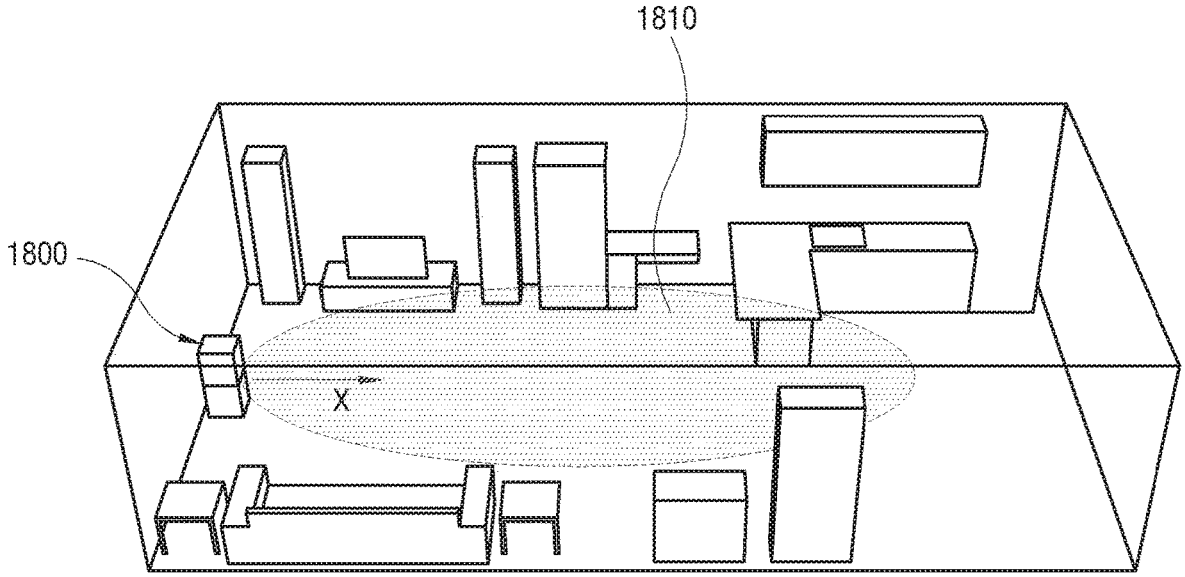
FIG. 18 illustrates a space in which a cold draft phenomenon is restrained when an air cleaner according to an embodiment of the disclosure is used under a predetermined use environment.

FIG. 18 illustrates a space in which a cold draft phenomenon is restrained when an air cleaner according to an embodiment of the disclosure is used under a predetermined use environment.

As shown in FIG. 18, an air cleaner 1800 is used being placed at one side within a predetermined use space. The air cleaner 1800 according to this embodiment has a cubical shape, and thus a plurality of air cleaners may be used being stacked up.

The air cleaner 1800 operating in the first mode discharges air of a relatively low wind-speed and air volume in the direction of 'X'. Such discharged air is directed toward a predetermined area 1810 positioned in front of the air cleaner 1800 in the direction of 'X'. In the first mode, the air cleaner 1800 according to the foregoing embodiments uniformly discharges air throughout the front panel, thereby restraining the cold draft phenomenon that a user feels in the corresponding area 1810. For example, the air cleaner 1800 has effects on achieving air which has a good dust concentration level of 30 $\mu g/m^3$ or below under a condition of a dust concentration level of 81 $\mu g/m^3$, a wind speed of 0.15 m/s or below, and noise attenuated by more than 5 dBA.

The methods according to the foregoing exemplary embodiments may be achieved in the form of a program command that can be implemented in various computers, and recorded in a computer readable medium. Such a computer readable medium may include a program command, a data file, a data structure or the like, or combination thereof. For example, the computer readable medium may be stored in a voltage or nonvolatile storage such as a read only memory (ROM) or the like, regardless of whether it is deletable or rewritable, for example, a RAM, a memory chip, a device or integrated circuit (IC) like memory, or an optically or magnetically recordable or machine (e.g., a computer)-readable storage medium, for example, a compact disk (CD), a digital versatile disk (DVD), a magnetic disk, a magnetic tape or the like. It will be appreciated that a memory, which can be included in a mobile terminal, is an example of the machine-readable storage medium suitable for storing a program having instructions for realizing the exemplary embodiments. The program command recorded in this storage medium may be specially designed and configured according to the exemplary embodiments, or may be publicly known and available to those skilled in the art of computer software.

The invention claimed is:

1. An air cleaner comprising:

a housing comprising an inlet and an outlet for air;

an air blower configured to blow air introduced through the inlet to the outlet;

a panel configured to face the outlet and comprising holes;

a driver configured to move the panel to project outwardly with respect to the housing; and a controller configured to control the driver to move the panel to project outwardly to open or close a channel between the outlet and the panel, wherein an air volume discharged through the channel when the channel is open, is larger than an air volume discharged through the holes of the panel when the channel is closed.

2. The air cleaner according to claim 1, wherein the controller moves the panel to a first position, at which the channel is closed, in a first mode among a plurality of operation modes, and moves the panel to a second position, at which the channel is opened, in a second mode of which air volume blown by the air blower is more than the air volume in the first mode.

3. The air cleaner according to claim 2, further comprising at least one grill plate coupled to at least one of the housing and the panel, disposed between the air blower and the panel, and formed with holes, wherein the holes of the panel have smaller diameters than the holes of the grill plate.

4. The air cleaner according to claim 2, further comprising a storage configured to store scheduling information in which time to enter the first mode is set, wherein the controller enters the first mode based on a current time corresponding to the time set in the scheduling information.

5. The air cleaner according to claim 2, further comprising a second sensor configured to detect dust concentration of a user environment of the air cleaner, wherein the controller enters the first mode based on the dust concentration detected by the second sensor not higher than a first threshold, but does not enter the first mode based on the detected dust concentration higher than the first threshold.

6. The air cleaner according to claim 5, wherein the controller displays a user interface (UI) for selecting whether to automatically enter the first mode, and performs control to automatically enter the first mode based on selection using the UI.

7. The air cleaner according to claim 1, wherein the driver comprises:

at least one rack extended from the panel toward the housing;

at least one pinion rotatably coupled to the housing and meshed with the rack; and a motor driving the at least one pinion to rotate, and the controller controls the motor to rotate the at least one pinion to close or open the channel.

8. The air cleaner according to claim 1, further comprising a first sensor to detect a user within a preset range of the air cleaner, wherein the controller stops moving the panel based on detection of a user in the first sensor while the panel is moving.

9. An air cleaner comprising:

a housing comprising an inlet and an outlet for air;

an air blower configured to blow air introduced through the inlet to the outlet;

a panel configured to face the outlet, spaced apart from the outlet to form a discharging channel for the air, and comprising holes;

a door rotatably provided in the housing and configured to open or close the discharging channel;

a driver configured to rotate the door; and a controller configured to control the driver to rotate the door to open or close the discharging channel, wherein an air volume discharged through the discharging channel when the discharging channel is open, is larger than an air volume discharged through the holes of the panel when the discharging channel is closed.

10. A method of controlling an air cleaner, comprising:

blowing, by an air blower, air introduced through an inlet of a housing to an outlet of the housing; and controlling a driver, by a controller, to move a panel to project outwardly to open or close a channel between the outlet and the panel facing the outlet and formed with holes, wherein an air volume discharged through the channel, when the channel is open, is larger than an air volume discharged through the holes of the panel when the channel is closed.

11. The method according to claim 10, wherein the discharging of the air volume comprises:

moving the panel to a first position, at which the channel is closed, in a first mode among a plurality of operation modes; and moving the panel to a second position, at which the channel is opened, in a second mode of which the air volume discharged through the channel is more than the air volume discharged through the holes in the first mode.

12. The method according to claim 11, wherein the moving of the panel to the first position comprises entering the first mode based on a current time corresponding to time which is set to enter the first mode in previously stored scheduling information.

13. The method according to claim 11, further comprising entering the first mode based on dust concentration in a user environment of the air cleaner not higher than a first threshold; and not entering the first mode based on the detected dust concentration higher than the first threshold.

14. The method according to claim 10, wherein the air cleaner comprises:

at least one rack extended from the panel toward the housing; and at least one pinion rotatably coupled to the housing and meshed with the rack, and the discharging of the air volume comprises rotating the at least one pinion to close or open the channel.

15. The method according to claim 10, further comprising stopping moving the panel based on detection of a user within a preset range of the air cleaner while the panel is moving.

* * * * *